US011839797B2

(12) United States Patent
Martens et al.

(10) Patent No.: US 11,839,797 B2
(45) Date of Patent: Dec. 12, 2023

(54) MULTI-MATERIAL GOLF CLUB HEAD

(71) Applicant: Acushnet Company, Fairhaven, MA (US)

(72) Inventors: Grant M. Martens, San Diego, CA (US); Uday V. Deshmukh, Carlsbad, CA (US); Scott A. Knutson, Escondido, CA (US); Charles E. Golden, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 1 day.

(21) Appl. No.: 17/484,835

(22) Filed: Sep. 24, 2021

(65) Prior Publication Data

US 2023/0101631 A1 Mar. 30, 2023

(51) Int. Cl.
*A63B 53/06* (2015.01)
*A63B 53/04* (2015.01)

(52) U.S. Cl.
CPC ..... *A63B 53/042* (2020.08); *A63B 53/0433* (2020.08); *A63B 53/0437* (2020.08)

(58) Field of Classification Search
CPC . A63B 53/04; A63B 53/0433; A63B 53/0466; A63B 2053/0491
USPC ..... 473/324–350
See application file for complete search history.

(56) References Cited

U.S. PATENT DOCUMENTS 5,106,094 A * 4/1992 Desbiolles ..... A63B 60/00 473/342
5,261,663 A * 11/1993 Anderson ..... A63B 53/04 473/345
5,518,240 A * 5/1996 Igarashi ..... A63B 60/00 473/345
5,706,566 A * 1/1998 Igarashi ..... A63B 53/04 228/125

(Continued)

FOREIGN PATENT DOCUMENTS

CA 2608831 A1 * 6/2008 ..... A63B 53/04
CN 102123769 B * 12/2015 ..... A63B 53/04

(Continued)

OTHER PUBLICATIONS

Tour Edge Exotics CBX fairway wood continues "combo-brazing" tradition of speed, low-spin and weight savings| golfdigest [online] golfdigest.com[retrieved on Oct. 8, 2021] Retrieved from the Internet <URL: https://www.golfdigest.com/story/tour-edge-exotics-cbx-fairway-wood-continues-combo-brazing-tradition-of-speed-low-spin-and-weight-savings >—2021.

(Continued)

*Primary Examiner* — Alvin A Hunter
(74) *Attorney, Agent, or Firm* — Ryan A. Reis

(57) ABSTRACT

A small-format metal wood golf club head may include a first portion including at least a striking face formed of an alloy of titanium and a second portion including at least a portion of a sole formed of an alloy of steel. The golf club head exhibits beneficial characteristics of both titanium and steel in that the titanium striking face is lighter than a steel (Continued)

striking face having the same coefficient of restitution (COR) and the steel sole allows for concentration of mass in a beneficial location within the golf club head, while overcoming traditional difficulties in bonding titanium and steel.

10 Claims, 19 Drawing Sheets

(56) References Cited

U.S. PATENT DOCUMENTS 5,769,735 A * 6/1998 Hosokawa ..... A63B 53/04 473/332
6,247,636 B1 * 6/2001 Sun ..... A63B 53/0466 228/175
6,558,271 B1 * 5/2003 Beach ..... A63B 60/00 473/334
6,719,645 B2 * 4/2004 Kouno ..... A63B 60/00 473/345
6,994,636 B2 * 2/2006 Hocknell ..... A63B 60/00 473/345
7,128,664 B2 * 10/2006 Onoda ..... A63B 53/0466 473/347
8,398,506 B2 * 3/2013 Stites ..... A63B 53/047 473/345
8,435,137 B2 * 5/2013 Hirano ..... A63B 53/0466 473/345
8,858,364 B2 * 10/2014 Deng ..... A63B 60/00 473/350
8,956,244 B1 * 2/2015 Westrum ..... A63B 53/04 473/345
8,986,133 B2 * 3/2015 Bennett ..... A63B 60/00 473/344
9,126,085 B2 * 9/2015 Sander ..... A63B 53/0466
9,504,889 B2 * 11/2016 Mitzel ..... A63B 60/52
9,814,954 B2 * 11/2017 Westrum ..... A63B 53/04
9,943,733 B2 * 4/2018 Franklin ..... A63B 53/04
10,343,032 B2 * 7/2019 Martens ..... A63B 60/02
2009/0270199 A1 * 10/2009 Chen ..... A63B 53/0466 473/348
2010/0056298 A1 * 3/2010 Jertson ..... A63B 60/00 228/101
2010/0203983 A1 * 8/2010 Stites ..... A63B 60/02 473/345
2012/0172147 A1 * 7/2012 McDonnell ..... A63B 53/0466 473/346
2013/0035178 A1 * 2/2013 Roach ..... A63B 53/0466 29/401.1
2013/0116065 A1 * 5/2013 Yamamoto ..... A63B 53/0466 473/345
2014/0080623 A1 * 3/2014 de la Cruz ..... A63B 60/00 473/329
2014/0080624 A1 * 3/2014 Galvan ..... A63B 53/0466 473/329
2014/0080626 A1 * 3/2014 Bezilla ..... A63B 60/52 473/332
2014/0080633 A1 * 3/2014 Bezilla ..... A63B 53/04 473/342
2014/0080634 A1 * 3/2014 Golden ..... A63B 53/0466 473/345
2014/0221125 A1 * 8/2014 Day ..... A63B 60/46 473/343
2015/0094164 A1 * 4/2015 Galvan ..... A63B 60/54 473/329
2015/0119163 A1 * 4/2015 De La Cruz ..... A63B 53/0466 473/329
2015/0126304 A1 * 5/2015 Cleghorn ..... A63B 60/52 473/338
2015/0165283 A1 * 6/2015 Martens ..... A63B 53/0466 473/329
2015/0174461 A1 * 6/2015 Bennett ..... A63B 53/0466 473/329
2015/0217167 A1 * 8/2015 Frame ..... A63B 60/54 473/329
2015/0343282 A1 * 12/2015 Franklin ..... A63B 53/0466 473/333
2015/0352415 A1 * 12/2015 Bennett ..... A63B 60/54 473/329
2016/0129319 A1 * 5/2016 Bennett ..... A63B 53/0466 473/345
2016/0346646 A1 * 12/2016 Bennett ..... A63B 60/00
2017/0014690 A1 * 1/2017 Morin ..... A63B 60/52
2018/0147459 A1 * 5/2018 Martens ..... A63B 60/00
2020/0023247 A1 * 1/2020 Larsen ..... A63B 53/0466

FOREIGN PATENT DOCUMENTS

GB 766831 A * 1/1957
JP 5980194 B2 * 8/2016 ..... A63B 53/04
JP 6378253 B2 * 8/2018 ..... A63B 53/04
JP 2020093081 A * 6/2020 ..... A63B 53/04

OTHER PUBLICATIONS

TaylorMade SIM Ti Fairway Review| Today's Golfer [online] todaysgolfer.co.uk [retrieved on Oct. 8, 2021] Retrieved from the Internet <URL: https://www.todaysgolfer.co.uk/equipment/golf-clubs/fairway-woods/taylormade/taylormade-sim-fairway/taylormade-sim-ti-fairway/>—2021.

* cited by examiner

700

800

MULTI-MATERIAL GOLF CLUB HEAD

FIELD OF THE INVENTION

The present invention is generally related to a golf club head, and more particularly related to a golf club head constructed of multiple materials.

BACKGROUND OF THE INVENTION

FIGS. 1 and 2 illustrate a conventional wood-type golf club. FIG. 1 is a perspective view of golf club head 100 and FIG. 2 is a heel-side view of the golf club head 100.

The golf club head 100 includes a crown 106, a sole 108 opposite the crown 106, a toe 102, and a heel 104 opposite the toe 102. A striking face 120 is provided at the front of the golf club head 100 and is adapted to strike a golf ball. A skirt 110 connects the crown 106 to the sole 108 and extends from the toe 102 proximate the striking face 120 to the heel 104 proximate the striking face 120. A hosel 118 is provided adjacent the heel 104 and facilitates attachment of the golf club head 100 to a shaft (not shown).

Traditionally wood-type golf club heads such as golf club head 100 were formed of persimmon. Over time, wood-type golf club heads have incorporated various materials that have different densities and strengths including steel, titanium, and tungsten among others.

The combination of strength and a density of about 4 g/cc has entrenched titanium as favored material for the construction of drivers as it allows golf club designers to not only increase the size of the golf club head, but also frees up more discretionary mass for golf club designers to position within the most favorable portions of the golf club head. However, steel, which has a higher density than titanium of about 7 g/cc remains a preferred material for the construction of small-format metal wood type golf club heads such as fairway woods, hybrids, and even low-volume drivers (e.g., less than 350 cc) because mass constraints are not as limiting in these small-format metal woods.

When designing small-format metal woods, designers seek clubs that are capable of generating superior distance, while also exhibiting substantial forgiveness on golf shots that are struck away from the center of the striking face by manipulating the center of gravity (CG) location and various moment of inertia (MOI) measurements of the golf club head.

Steel golf club heads are fast, large and forgiving, while titanium golf club heads may be constructed to be larger and generally more forgiving when compared to their steel brethren. However, the large footprint of titanium golf clubs does not instill confidence when used to strike a golf ball that is not placed upon a tee, as is often the case when striking a small-format metal wood.

The governing bodies of the game of golf, the USGA and the R&A, have set a speed limit of sorts on metal woods. For some time, the speed at which a golf ball rebounded off of the striking face was used to enforce this speed limit by a metric called coefficient of restitution (COR). However, the test for COR does not travel very well as it requires a cannon to fire a golf ball at over 150 MPH. Currently a test in which a small metallic pendulum is swung against the striking face to determine a characteristic time (CT) of the striking face is used to enforce the speed limit of the striking face.

Both steel and titanium striking faces can be engineered to push up against the maximum COR and the maximum CT allowed by the governing bodies. However, in consideration of the metallurgical properties of steel and titanium, a titanium striking face may be constructed to have a reduced mass when compared to a steel striking face when both striking faces exhibit the same or similar COR and CT values.

However, it also must be noted that while a golf club combining steel and titanium affords theoretical benefits, it remains difficult to join steel and titanium. The relative metallurgical incompatibility between steel and titanium presents difficulties in producing reliable joints via welding and brazing.

Therefore, what is needed is a small-format golf club head that can draw upon the strengths of both titanium and steel constructions to maximize the performance of the striking face while maintaining the small-format that makes small-format metal wood golf club heads more playable and fully utilizing alternative and additional joining methods to overcome conventional shortfalls associated with the metallurgical incompatibility between steel and titanium.

BRIEF SUMMARY OF THE INVENTION

According to one aspect of the present invention, a golf club head includes a striking face at a front portion of said golf club head, a crown, a sole opposite said crown, a heel, a toe opposite said heel, a hosel adjacent said heel, and a skirt joining said crown to said sole and extending from said toe proximate said striking face to said heel proximate said striking face, said golf club head further includes a first portion including at least said striking face, said first portion formed of a first material including an alloy of titanium; and a second portion including at least a rear portion of said sole of said golf club head, said second portion formed at least partially of a second material including an alloy of steel, where said first portion is joined to said second portion by at least one of welding, brazing, adhesives, mechanical fasteners, and mechanical locking.

According to another aspect of the present invention, a golf club head includes a striking face at a front portion of said golf club head, a crown, a sole opposite said crown, a heel, a toe opposite said heel, a hosel adjacent said heel, and a skirt joining said crown to said sole and extending from said toe proximate said striking face to said heel proximate said striking face, said golf club head further including a first portion including said striking face, said crown, and said skirt, said first portion formed of a first material including an alloy of titanium; and a second portion including at least a portion of said sole, said second portion formed at least partially of a second material including an alloy of steel, where said first portion is joined to said second portion by at least one of adhesives, mechanical fasteners, and mechanical locking.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
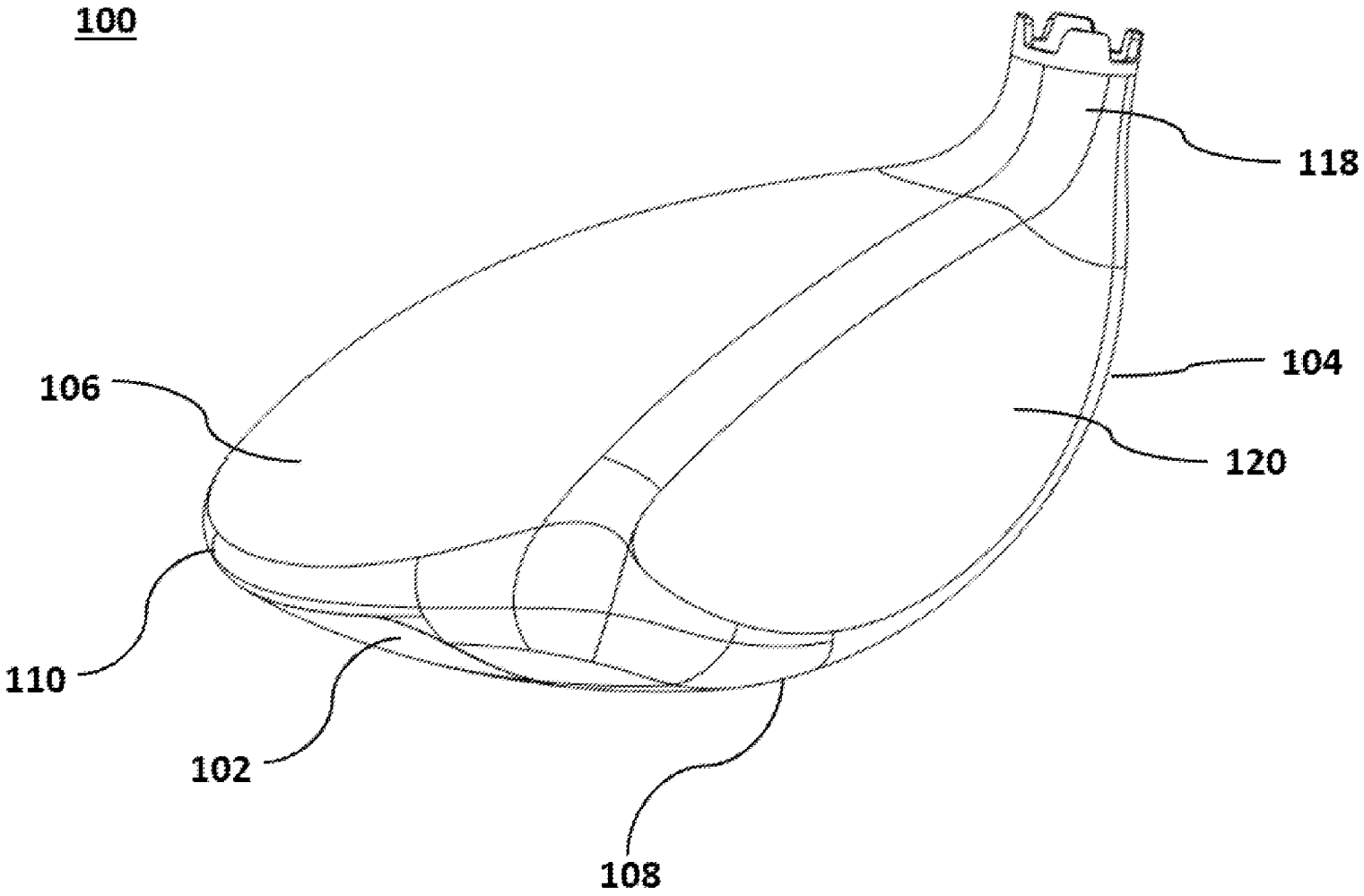
FIG. 1 of the accompanying drawings shows a perspective view of a conventional golf club head.
Figure 2:
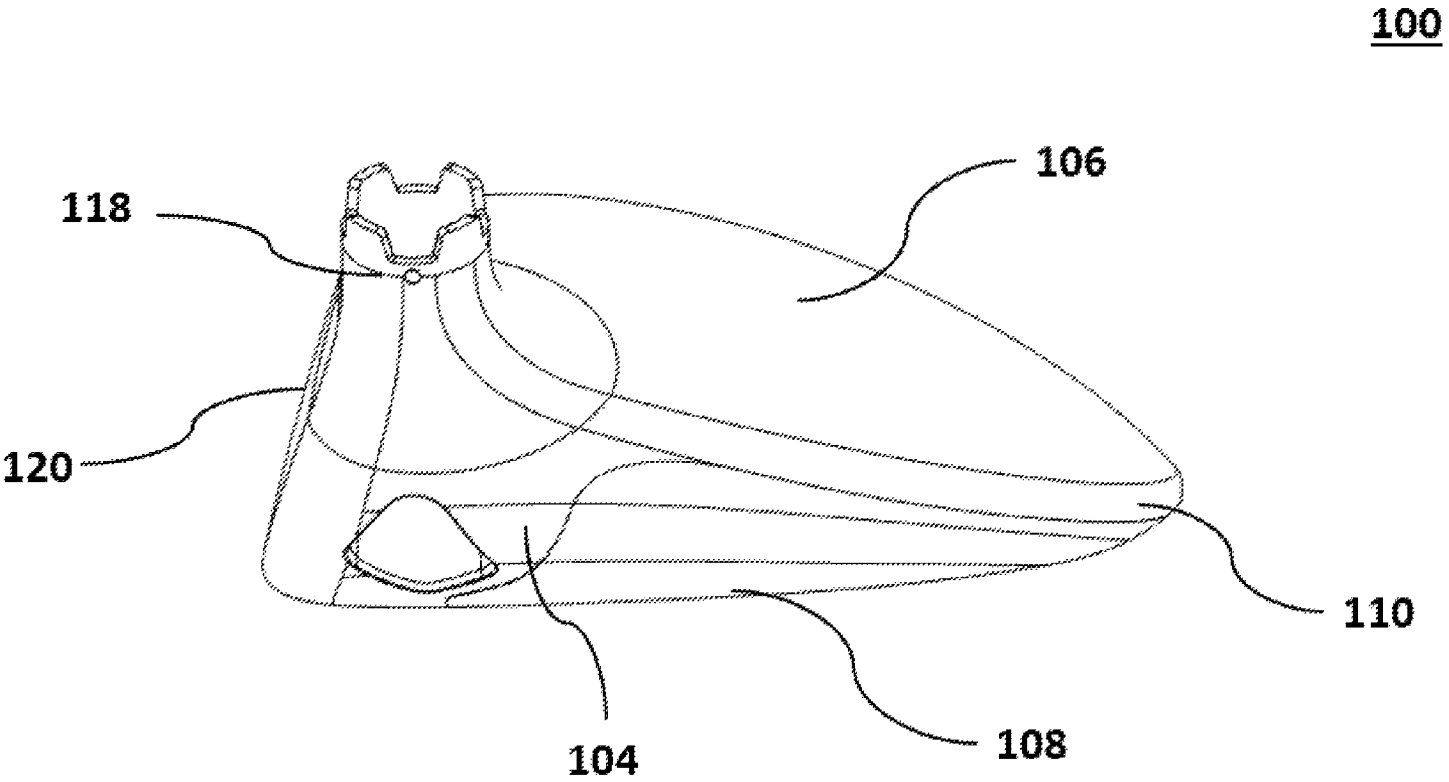
FIG. 2 of the accompanying drawings shows a heel-side view of a conventional golf club head.
Figure 3:
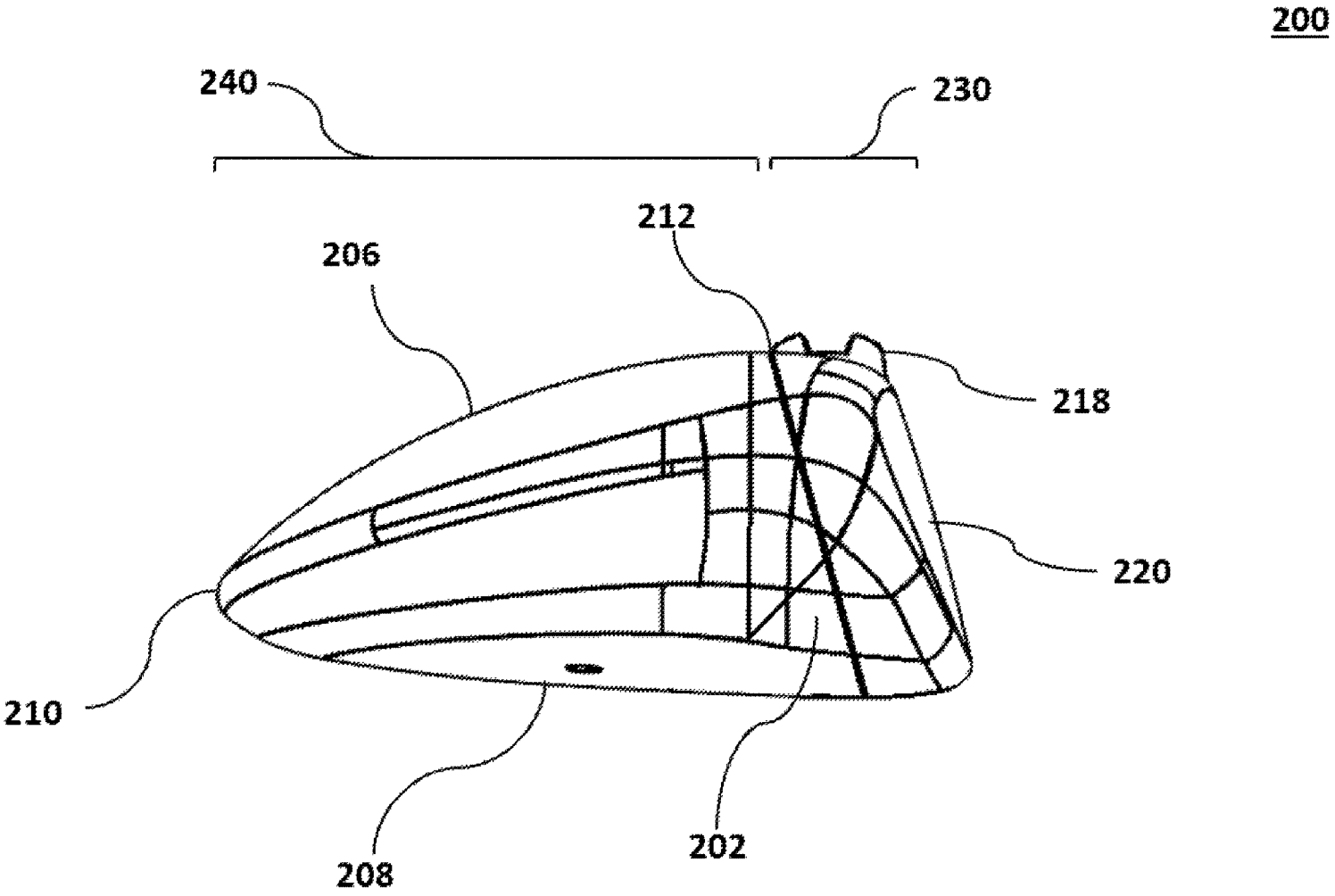
FIG. 3 of the accompanying drawings shows a toe-side view of a golf club head in accordance with an exemplary embodiment of the present invention.
Figure 4:
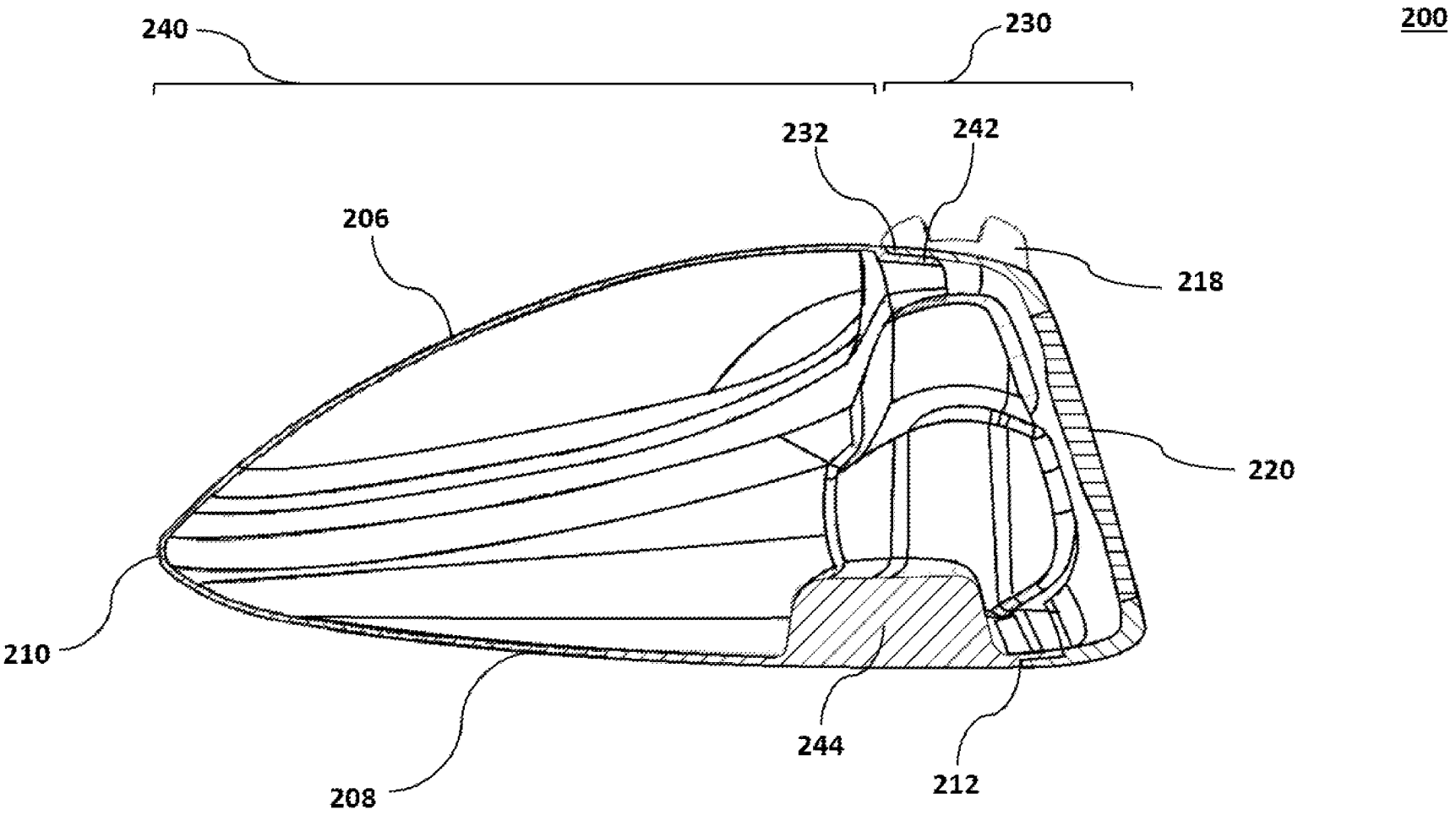
FIG. 4 of the accompanying drawings shows a toe-side cross-sectional view of the golf club head of FIG. 3 taken along a vertical plane passing through the center of the striking face and extending in a fore-aft direction.

FIGS. 3-4 illustrate a golf club head 200 in accordance with an embodiment of the present invention. FIG. 3 is a toe-side view of the golf club head 200 and FIG. 4 is a toe-side cross-sectional view of golf club head 200 taken along a vertical plane extending in a fore-aft direction and passing through a center of a striking face 220 of golf club head 200.

Referring to FIG. 3, at first glance the golf club head 200 does not appear very different from golf club head 100. However, taking a closer look, and also a look inside of golf club head 200, sheds additional light on what makes golf club head 200 unique. The first sign that golf club head 200 is a little different is parting line 212. Parting line 212 generally divides golf club head 200 into a first portion 230 and a second portion 240 and is shown in a heavier line weight for emphasis. In the present embodiment, the first portion 230 is located at the front of the golf club head 200 and includes the striking face 220, the hosel 218, and frontal portions of the crown 206, sole 208, skirt 210, heel (not shown), and toe 202. According to an embodiment of the present invention, the first portion 230 may be a face cup that includes the striking face 220 and extends rearward from the striking face 220 to the parting line 212. The second portion 240 is located at the rear of the golf club head 200 and includes the rear portions of the crown 206, sole 208, skirt 210, toe 202, and heel (not shown).

Preferably, golf club head 200 has a maximum depth measured from the striking face 220 to the rear of the golf club head 200 of between about 50 mm to about 95 mm, a peak crown height measured from the highest point on the crown 206 to the ground when the golf club head 200 is positioned in a normal address position of between about 30 mm to about 50 mm, a volume of between about 80 cc to about 350 cc, and a total mass of about 200 g to about 270 g.

According to an exemplary embodiment of the present invention, the first portion 230 may be formed of an alloy of titanium. While the first portion 230 may be formed through casting, forging, or any known method, preferably the first portion 230 is formed through a casting process. The first portion 230 may include at least one of an Alpha Titanium alloy, an Alpha-Beta Titanium Alloy, and a Beta Titanium Alloy. According to some embodiments as shown in FIG. 3, the striking face 220 of the first portion 230 may be a separate piece formed through a separate casting or forging process and subsequently attached to remainder of the first portion 230. In one embodiment, the striking face 220 takes on the shape of a face insert, may also be formed out of at least one of an Alpha Titanium alloy, an Alpha-Beta Titanium Alloy, a Beta Titanium Alloy, and a Heavy Beta Titanium Alloy with a low Young's Modulus and high density.

According to an embodiment of the present invention, the second portion 240 may be formed of any number of known steel alloys.

The combination of a second portion 240 being an alloy of steel and the first portion 230 being an alloy of titanium yields several interesting benefits while simultaneously requiring several novel solutions.

As noted above, small-format metal woods such as fairway woods and hybrid clubs are typically formed predominantly of steel. The golf club head 200 exhibits the combined benefits of steel and titanium in the traditionally smaller package of a hybrid or fairway wood. Specifically, by forming the first portion 230 of an alloy of titanium, additional discretionary mass may be moved to more beneficial positions within the golf club head 200, for example toward the sole 208 of the golf club head 200. However, it also must be noted that while a golf club combining steel and titanium affords theoretical benefits, it remains difficult to join steel and titanium. The relative metallurgical incompatibility between steel and titanium presents difficulties in producing reliable joints via welding and brazing, thus alternative and additional joining methods are critical to the present invention.

When compared to a steel faced golf club head of substantially identical mass and loft, the golf club head 200 was found to have a CT that was as much as 2.0 μs less than the steel faced golf club head, a center face ball speed that was as much as 0.3 mph faster that the steel faced golf club head, and a COR that was as much as 0.008 ft/s greater than that of the steel faced golf club head. Such an increase in ball speed and COR coupled with a reduction in CT is a marked improvement over conventional golf club heads and can lead to distance increases of nearly 5.0 yards as compared to the steel faced golf club head.

The first portion 230 may account for between about 5 percent to about 35 percent of the total mass of the golf club head 200. More preferably, the first portion 230 may account for between about 5 percent to about 30 percent of the total mass of the golf club head 200. Most preferably, the first portion 230 may account for between about 5 percent to about 25 percent of the total mass of the golf club head 200.

The first portion 230 may account for between about 5 percent to about 45 percent of the external surface area of the golf club head 200. More preferably, the first portion 230 may account for between about 5 percent to about 40 percent of the external surface area of the golf club head 200. Most preferably, the first portion 230 may account for between about 5 percent to about 35 percent of the external surface area of the golf club head 200.

The second portion 240 may account for between about 65 percent to about 95 percent of the total mass of the golf club head 200. More preferably, the second portion 240 may account for between about 70 percent to about 95 percent of the total mass of the golf club head 200. Most preferably, the second portion 240 may account for between about 75 percent to about 95 percent of the total mass of the golf club head 200.

The second portion 240 may account for between about 55 percent to about 95 percent of the external surface area of the golf club head 200. More preferably, the second portion 240 may account for between about 60 percent to about 95 percent of the external surface area of the golf club head 200. Most preferably, the second portion 240 may account for between about 65 percent to about 95 percent of the external surface area of the golf club head 200.

Referring now to FIG. 4, a toe-side sectional view of golf club head 200 taken along a vertical plane passing through the center of the striking face 220 and extending in a fore-aft direction provides a view of the inner workings of the golf club head 200.

As shown in FIG. 4, the first portion 230 includes a first attachment surface 232 and the second portion 240 includes a second attachment surface 242. In the present embodiment, the first attachment surface 232 extends along an entire interior surface of a rear circumference of the first portion 230 from sole 208, to heel (not shown) to crown 206, to toe (not shown). Similarly, the second attachment surface 242 extends along an outer surface of an entire front circumference of the second portion 240 from sole 208, to heel (not shown) to crown 206, to toe (not shown). The sectional shape of the first attachment surface 232 may vary at different positions on the golf club head 200. For example, the sectional shape of the first attachment surface 232 may differ between the sole 208 and the crown 206. The sectional shape of the second attachment surface 242 may also differ at different positions of the golf club head 200, preferably in a manner that corresponds with the sectional shape of the first attachment surface 232. While the second attachment surface 242 is depicted as nesting entirely within the first attachment surface 232, it should be understood that it is within the scope and content of the present invention for the first attachment surface 232 to at least partially nest within the second attachment surface 242 such that the second attachment surface 242 may define a portion of the exterior of the golf club head 200.

According to an exemplary embodiment of the present invention, the first portion 230 may be joined to the second portion 240 via brazing, adhesives, one or more mechanical fasteners, or a mechanical lock. Although it is generally known that the welding of titanium to steel is difficult to achieve, it should be noted that the present invention does not exclude welding as a joining method, and the first portion 230 and the second portion 240 may also be welded to one other should new materials develop or welding techniques improve, also without departing from the scope and content of the present invention.

FIG. 4 also shows a first mass portion 244 located on an interior surface of the sole 208 proximate the parting line 212. It is within the scope and content of the present invention for the first mass portion 244 to be disposed centrally between the heel and toe of the golf club head 200 or to extend toward one or both of the heel and toe. Alternatively, the first mass portion 244 may be implemented as multiple discrete mass portions located at discrete portions within the golf club head 200. In the present exemplary embodiment, the first mass portion 244 may be formed integrally with the second portion 240 of the golf club head 200. Alternatively, the first mass portion 244 may be formed separately from the second portion 240 of the golf club head 200 and subsequently attached thereto. For example, the first mass portion 244 may be attached to an interior or exterior surface of the golf club head 200 via welding, brazing, adhesive, or a mechanical fastener. In such a case, it is preferable that the first mass portion 244 includes a material having a higher density than that of the first portion 230 and/or the second portion 240 such as tungsten, molybdenum, tantalum, hafnium, niobium, or steel.

The first mass portion 244 serves several critical functions. First of all, it allows for the fine tuning of the location of the center of gravity of the golf club head and the various moments of inertia measured about the center of gravity of the golf club head. Secondly, the first mass portion 244 allows for the mass and volume of the golf club head to be similar to a golf club head formed predominantly of steel. While there is no requirement that a fairway wood or hybrid formed at least partially of titanium maintain the same dimensions as their predominantly steel counterparts, it certainly can be beneficial for the reasons set forth above. Utilization of an alloy of titanium in the formation of the first portion 230 rather than an alloy of steel may reduce the mass of the second portion 230 by as much as about 40 g. As described above, any weight saved when utilizing materials that are less dense that steel may be reallocated as discretionary weight, for example within first mass portion 244.

According to another embodiment, the first portion 230 and the striking face 220 may be replaced with a face cup formed of an alloy of zirconium with a frontal opening adapted to receive a striking face insert formed of titanium. The titanium striking face insert may be welded into the zirconium face cup, which may be joined to a steel second portion via at least one of brazing, adhesives, mechanical fasteners, and mechanical locks. Preferably, the zirconium face cup may be brazed to the steel second portion. As the density of zirconium is about 2 g/cc greater than that of titanium, utilization of zirconium in the face cup allows for the center of gravity of the golf club head to be more forward toward the striking face when compared to a golf club head having a face cup and a striking face both made of titanium.

Figure 5:
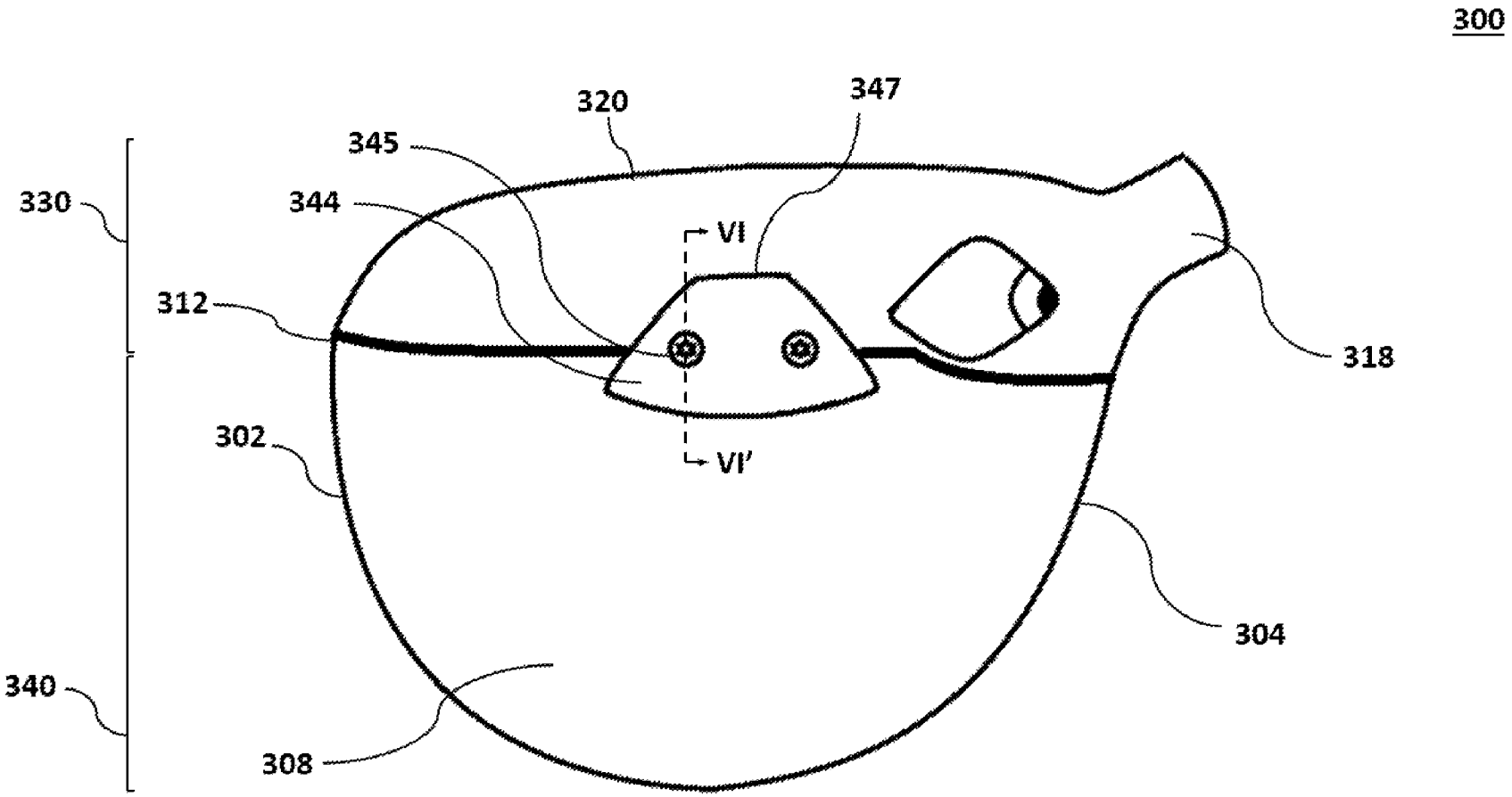
FIG. 5 of the accompanying drawings shows a sole view of a golf club head in accordance with another exemplary embodiment of the present invention.
Figure 6:
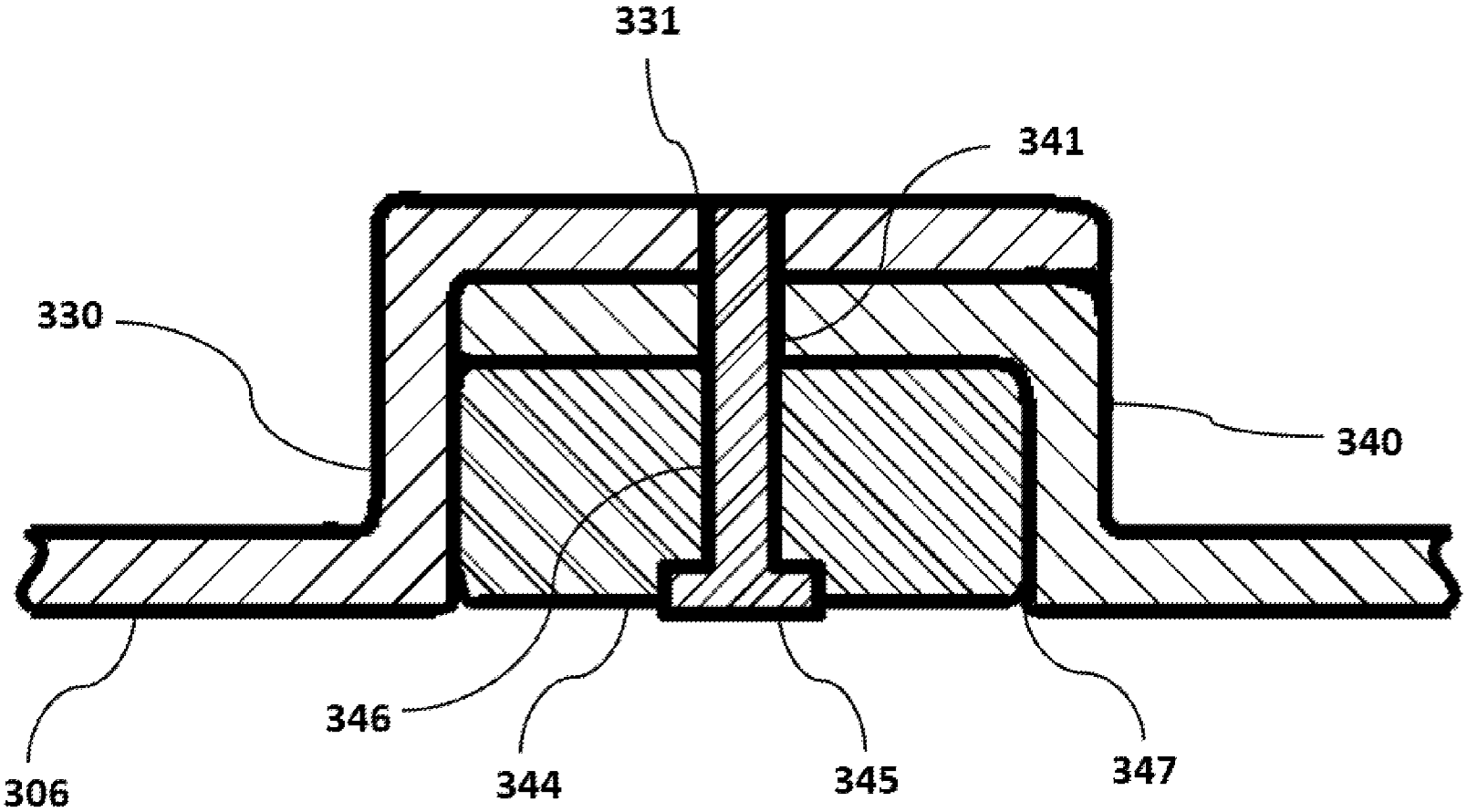
FIG. 6 of the accompanying drawings shows a partial cross-sectional view of the golf club head of FIG. 5 taken along the line VI-VI' shown in FIG. 5.

Referring now to FIGS. 5 and 6, a golf club head 300 according to another embodiment of the present invention is provided. FIG. 5 is a bottom view of golf club head 300 and FIG. 6 is a cross-sectional view of golf club head 300 taken along the line V-V' in FIG. 5.

Golf club head 300 is similar to the other exemplary golf club heads in that it includes a first portion 330 and a second portion 340. According to an exemplary embodiment, the first portion 330 includes a frontal portion of the golf club head 300 including the striking face 320, the hosel 318, and forward portions of the sole 308, the toe 302, the crown (not shown), and the heel 304. The second portion 340 includes a rear portion of the golf club head 300 including rear portions of the sole 308, the toe 302, the crown (not shown), and the heel 304.

As above, the first portion 330 preferably includes an alloy of titanium while the second portion 340 preferably includes an alloy of steel. While the first portion 330 and the second portion 340 may be joined together by any joining method such as adhesives, welding, mechanical fasteners, mechanical locks, and brazing; in the present embodiment, the first portion 330 and the second portion 340 are at least partially joined together by mechanical fasteners as described below. As golf club head 300 includes the first portion 330 and the second portion 340, and is similarly formed of a combination of titanium and steel, golf club head 300 may exhibit the same mass and inertial properties as golf club head 200, thus discussion thereof is omitted for the sake of brevity.

The first portion 330 may account for between about 5 percent to about 35 percent of the total mass of the golf club head 300. More preferably, the first portion 330 may account for between about 5 percent to about 30 percent of the total mass of the golf club head 300. Most preferably, the first portion 330 may account for between about 5 percent to about 25 percent of the total mass of the golf club head 300.

The first portion 330 may account for between about 5 percent to about 45 percent of the external surface area of the golf club head 300. More preferably, the first portion 330 may account for between about 5 percent to about 40 percent of the external surface area of the golf club head 300. Most preferably, the first portion 330 may account for between about 5 percent to about 35 percent of the external surface area of the golf club head 300.

The second portion 340 may account for between about 65 percent to about 95 percent of the total mass of the golf club head 300. More preferably, the second portion 340 may account for between about 70 percent to about 95 percent of the total mass of the golf club head 300. Most preferably, the second portion 340 may account for between about 75 percent to about 95 percent of the total mass of the golf club head 300.

The second portion 340 may account for between about 55 percent to about 95 percent of the external surface area of the golf club head 300. More preferably, the second portion 340 may account for between about 60 percent to about 95 percent of the external surface area of the golf club head 300. Most preferably, the second portion 340 may account for between about 65 percent to about 95 percent of the external surface area of the golf club head 300.

As shown in FIGS. 5-6, the golf club head 300 also includes a first mass portion 344 located proximate the sole 308. As shown in FIG. 5, the first mass portion 344 is positioned external to the golf club head 300 and is attached to the golf club head 300 via one or more mechanical fasteners 345. The first portion 330 and the second portion 340 collectively define a recess 347 for receiving the first mass portion 344 such that an external surface of the first mass portion 344 may be substantially even with an external surface of the sole 308. It is also within the scope and content of the present invention for an external surface of the first mass portion 344 to be recessed from an external surface of the sole 308, or for an external surface of the first mass portion 344 to protrude from an external surface of the sole 308.

The first mass portion 344 is preferably formed of a material having a density greater than that of the first portion 330 and/or the second portion 340. For example, the first mass portion 344 may be formed of a material containing at least one of tungsten, molybdenum, tantalum, hafnium, niobium, or steel.

Referring now to FIG. 6, a partial sectional view taken along the line VI-VI' in FIG. 5 is provided to better illustrate how the one or more mechanical fasteners 345 are utilized to not only secure the first mass portion 344 to the golf club head 300, but also to join the first portion 330 and the second portion 340. As shown in FIG. 6, the mechanical fastener 345 passes through a first mass portion opening 346 defined in the first mass portion 344, a second portion opening 341 defined in the second portion 340, and a first portion opening 331 defined in the first portion 330. Thus a longitudinal axis of the mechanical fastener 345 is aligned with each of the first mass portion opening 346, the first portion opening 331, and the second portion opening 341. Any or all of the first mass portion opening 346, the first portion opening 331, and the second portion opening 341 may be threaded to mate with corresponding threads defined on the fastener 345. Preferably, at least the first portion opening 331 includes threads that mate with corresponding threads defined on the fastener 345 so that the fastener 345 may apply a compressive force through each of the first mass portion 344, the second portion 340, and the first portion 330 so as to not only secure the first mass portion 344 in place, but also to join the first portion 330 to the second portion 340.

According to an alternative embodiment, the order of the first portion 330 and the second portion 340 may be reversed such that the fastener 345 passes through the first mass portion opening 346, the first portion opening 331, and the second portion opening 341. In such a case each of the first mass portion opening 346, the first portion opening 331, and the second portion opening 341 may include threads that mate with corresponding threads defined on the fastener 345. Preferably, threads are formed on at least the second portion opening 341 and the fastener 345.

It is also within the scope and content of the present invention for the first mass portion 344 to be disposed within the interior of the golf club head 300. In such a case it is preferable that at least the first mass portion opening 346 defined in the first mass portion 344 includes threads that correspond with threads defined in the fastener 345 so that the fastener 345 may apply a compressive force through each of the first mass portion 344, the first portion 330, and the second portion 340 so as to not only secure the first mass portion 344 in place, but also to join the first portion 330 to the second portion 340.

Figure 7:
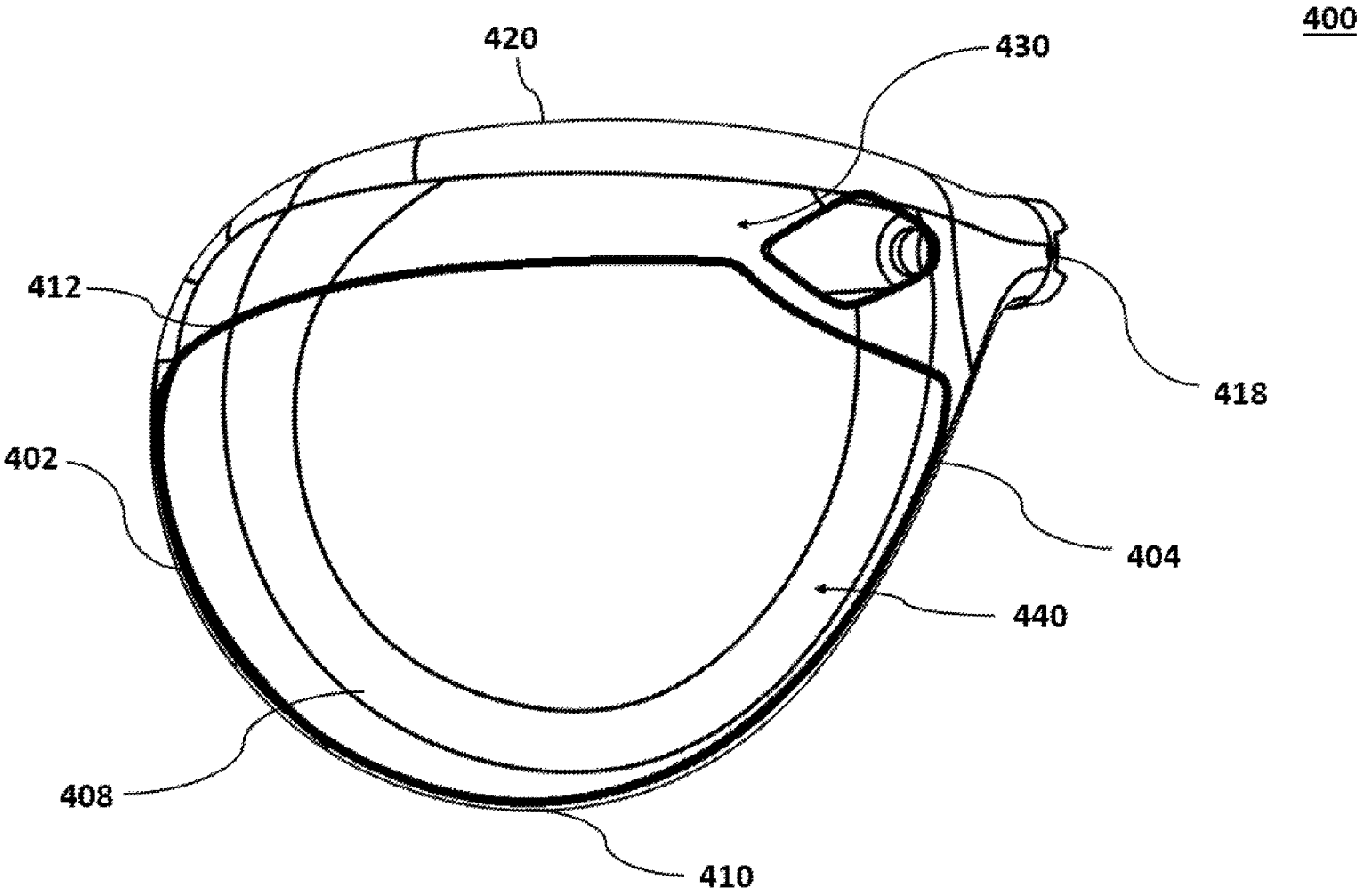
FIG. 7 of the accompanying drawings shows a sole view of a golf club head in accordance with another exemplary embodiment of the present invention.
Figure 8:
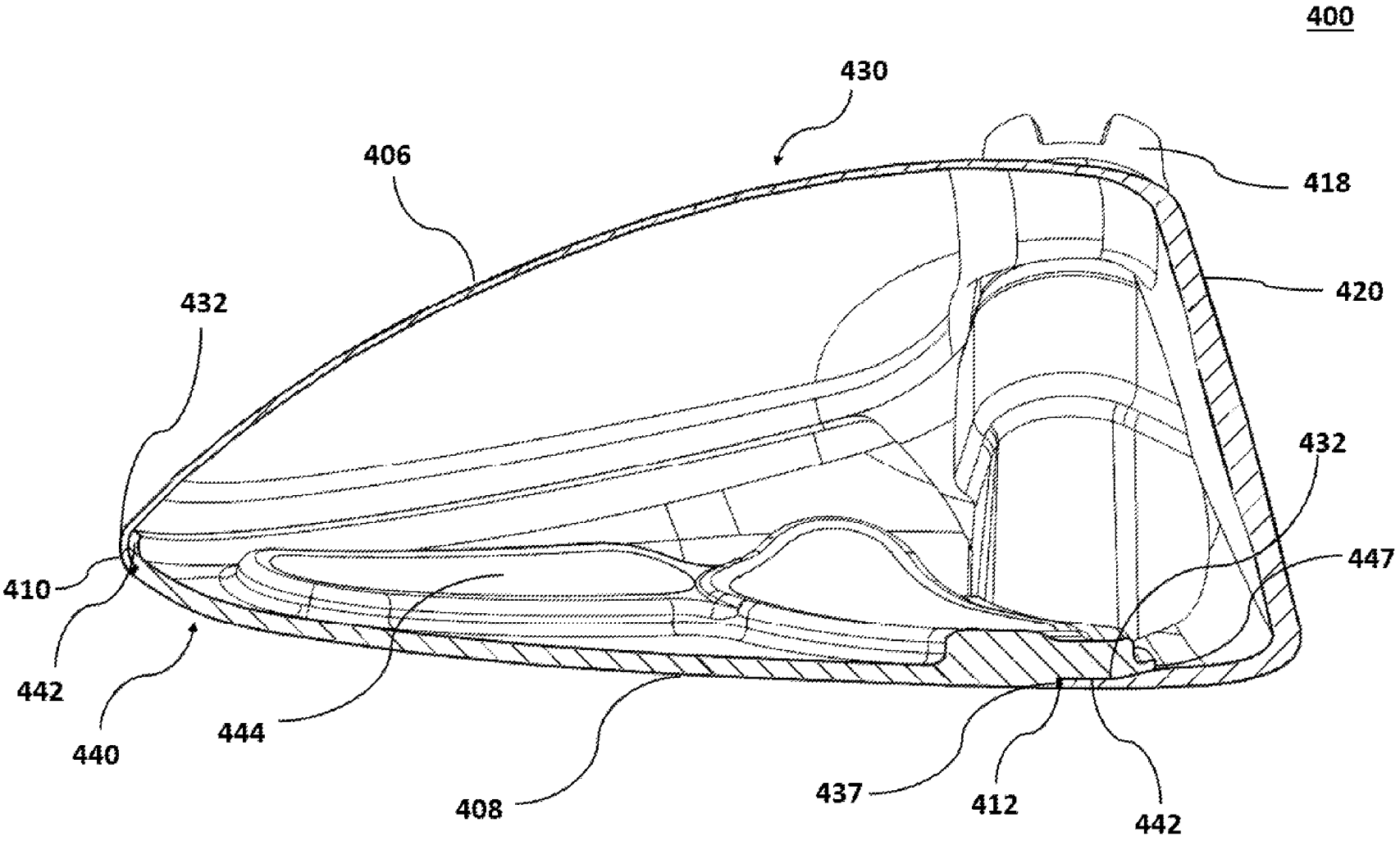
FIG. 8 of the accompanying drawings shows a toe-side cross-sectional view of the golf club head of FIG. 5 taken along a vertical plane passing through the center of the striking face and extending in a fore-aft direction.

Referring now to FIGS. 7-8, a golf club head 400 according to another exemplary embodiment of the present invention is shown. FIG. 7 is a sole view of golf club head 400 and FIG. 8 is a toe-side sectional view taken along a vertical plane extending in a fore-aft direction and passing through the center of the striking face 420.

As shown in FIGS. 7 and 8, golf club head 400 is similar to the other exemplary golf club heads in that it includes a first portion 430 formed at least partially of an alloy of titanium and a second portion 440 formed at least partially of an alloy of steel. Golf club head 400 differs from the earlier exemplary golf club heads in that substantially the entire crown 406 is defined by the first portion 430 of golf club head 400. The first portion 430 of golf club head 400 includes the striking face 420, the hosel 418, forwardmost portions of the sole 408, the toe 402, and the heel 404, and the crown 406, and the external portion of the skirt 410. The first portion 430 and the second portion 440 are separated by parting line 412, which is shown with a heavier line weight for emphasis. As noted above, the striking face 420 may be formed concurrently with the other elements of the first portion 430, or alternatively, the striking face 420 may be formed separately from the other elements of the first portion 430 and subsequently joined thereto. Golf club head 400 shares the benefits of the above golf club heads in that the titanium striking face 420 may be constructed to have a reduced mass when compared to a steel striking face when both striking faces exhibit the same or similar COR. Golf club head 400 also exhibits the inertial benefits associated with utilizing steel in the sole 408 to concentrate mass in the lower portion of the golf club head 400.

Referring now to FIG. 8, a toe-side cross-sectional view of golf club head 400 taken along a vertical plane extending in a fore-aft direction and passing through the center of the striking face 420 is provided.

FIG. 8 more clearly shows how the first portion 430 defines the external surface of the skirt 410 and also the interface between the first portion 430 and the second portion 440. One or more first attachment surfaces 432 are positioned proximate at least a portion of a first portion perimeter 437 which follows the parting line 412. The second portion 440 defines the sole 408 of golf club head 400 and defines a second portion perimeter 447 which follows the parting line 412. One or more second attachment surfaces 442 are positioned proximate at least a portion of the second portion perimeter 447.

Put another way, the first portion perimeter 437 defines an opening in the sole 408 of the golf club head 400, and the second portion 440 defines a sole insert that forms the sole 408 of the golf club head 400.

The first portion 430 may account for between about 20 percent to about 40 percent of the total mass of the golf club head 400. More preferably the first portion 430 may account for between about 25 percent to about 35 percent of the total mass of the golf club head 400. Most preferably, the first portion 430 may account for between about 28 percent to about 32 percent of the total mass of the golf club head 400.

The first portion 430 may account for between about 60 percent to about 80 percent of the external surface area of the golf club head 400. More preferably the first portion 430 may account for between about 65 percent to about 75 percent of the external surface area of the golf club head 400. Most preferably, the first portion 430 may account for between about 70 percent to about 72 percent of the external surface area of the golf club head 400.

The second portion 440 may account for between about 60 percent to about 80 percent of the total mass of the golf club head 400. More preferably the second portion 440 may account for between about 65 percent to about 75 percent of the total mass of the golf club head 400. Most preferably, the second portion 440 may account for between about 68 percent to about 72 percent of the total mass of the golf club head 400.

The second portion 440 may account for between about 20 percent to about 40 percent of the external surface area of the golf club head 400. More preferably the second portion 440 may account for between about 25 percent to about 35 percent of the external surface area of the golf club head 400. Most preferably, the second portion 440 may account for between about 28 percent to about 30 percent of the external surface area of the golf club head 400.

The first portion 430 and the second portion 440 may be joined together along the interface of the one or more first attachment surfaces 432 and the one or more second attachment surfaces 442. While the present embodiment depicts the one or more first attachment surfaces 432 of the first portion 430 as being recessed from the exterior of the golf club head 400 relative to the one or more second attachment surfaces 442, the present invention is not limited in this regard. It is also within the scope and content of the present invention for the one or more second attachment surfaces 442 to be recessed from the exterior of the golf club head 400 relative to the one or more first attachment surfaces 432, for some portions of the one or more first attachment surfaces 432 to be recessed relative to some portions of the one or more second attachment surfaces 442 while other portions of the one or more second attachment surfaces 442 are recessed relative to other portions of the one or more first attachment surfaces 432, or even for the first attachment surfaces 432 to abut the second attachment surfaces 442 so as to define a butt joint. As described above, the first portion 430 may be joined to the second portion 440 via any known method including brazing, adhesive, mechanical fastener, and mechanical locking.

FIG. 8 also shows a first mass portion 444. As above, the first mass portion 444 is positioned on an interior surface of the sole 408 to most beneficially allocate discretionary mass afforded by the utilization of titanium in the striking face 420 and the crown 406. First mass portion 444 may be formed monolithically with the second portion 440. Alternatively, the first mass portion 444 may be formed separately from the second portion 440 and attached thereto. When the first mass portion 444 is formed separately from the second portion 440, the first mass portion 444 may be preferably formed of a material having a density greater than that of the second portion 440, such as a material containing at least one of tungsten, molybdenum, tantalum, hafnium, niobium, or steel.

As yet another alternative, it is also within the scope and content of the present invention for the second portion 440 to define at least a portion of the skirt 410 and/or a portion of the crown 406 in a case where the parting line is moved crownward.

Figure 9:
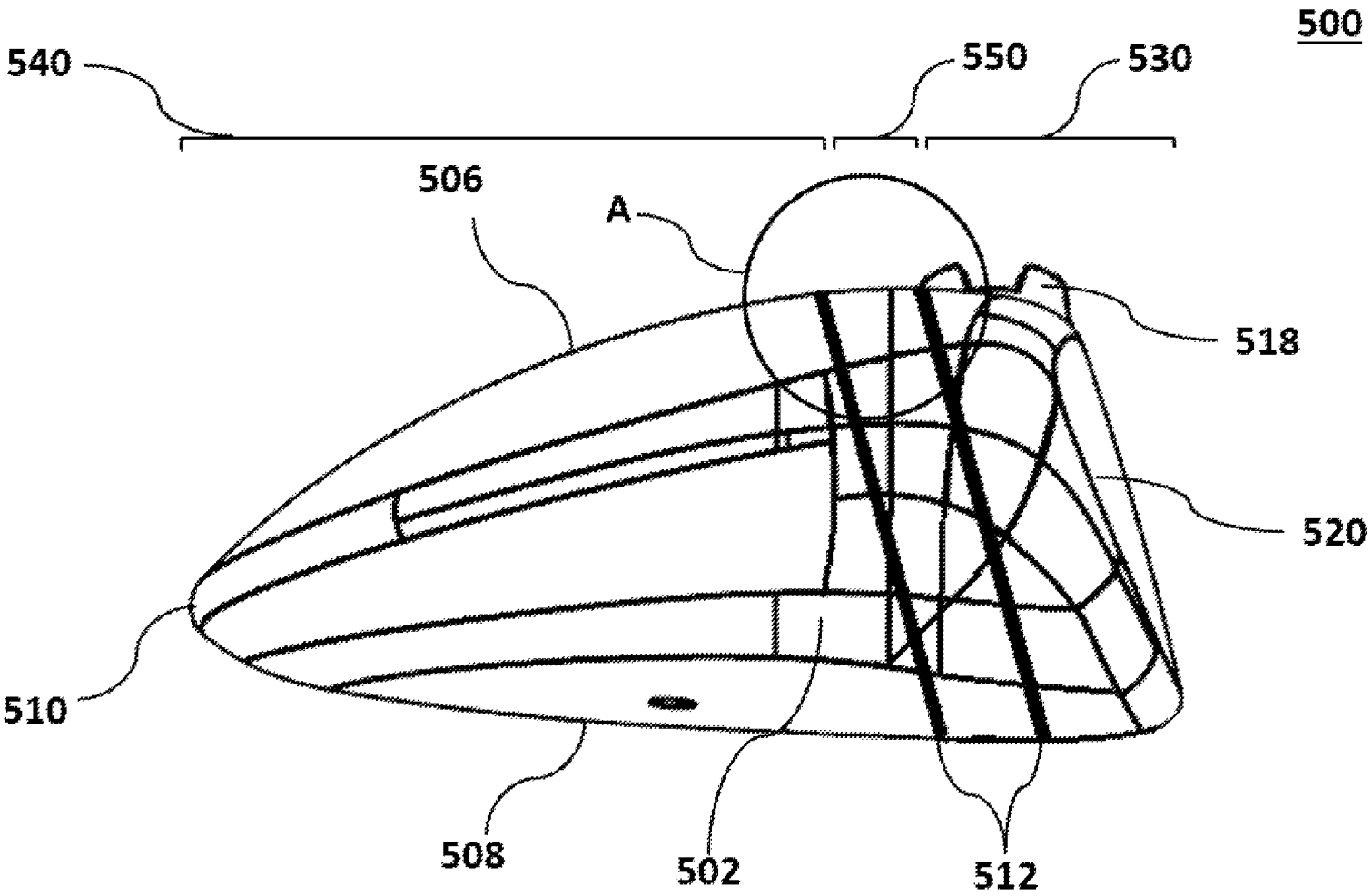
FIG. 9 of the accompanying drawings shows a toe-side view of a golf club head in accordance with another exemplary embodiment of the present invention.
Figure 10:
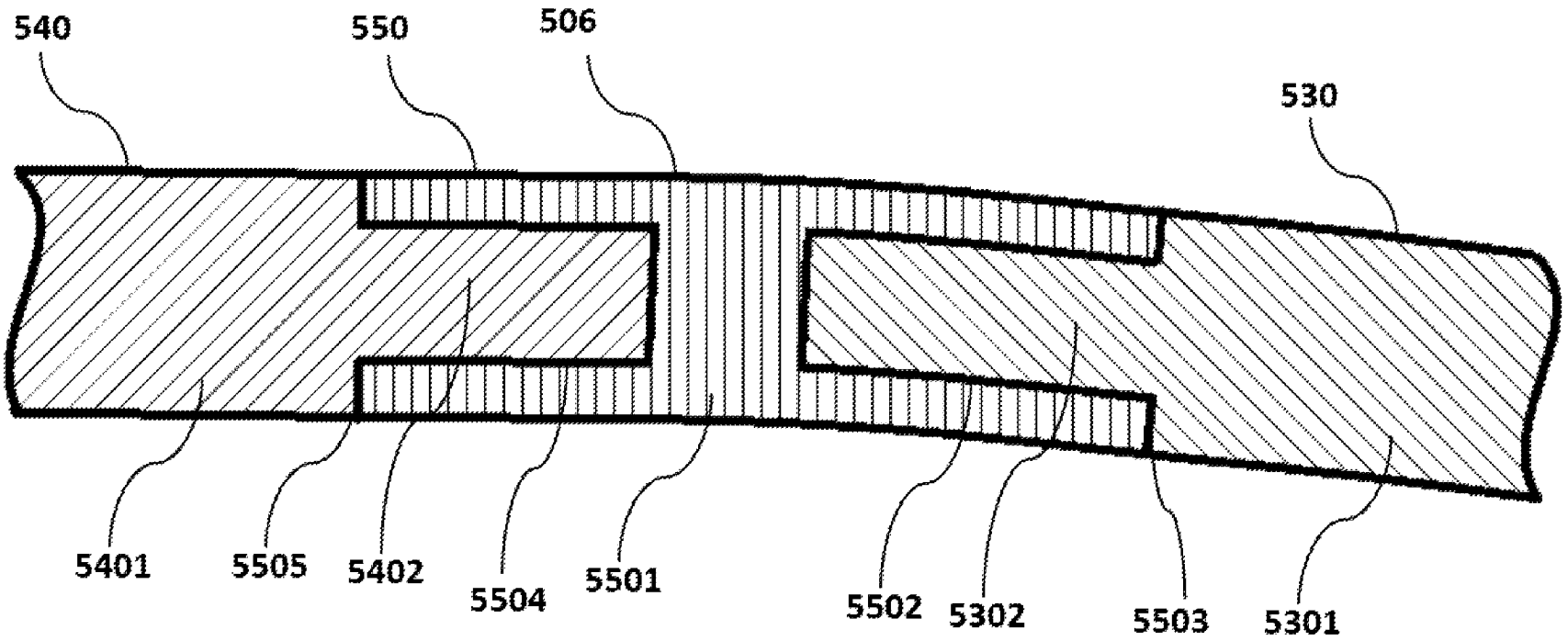
FIG. 10 of the accompanying drawings shows an enlarged cross-sectional view of the golf club head of FIG. 9.

Referring now to FIGS. 9-10, a golf club head 500 according to another exemplary embodiment of the present invention is shown. FIG. 9 is a toe-side view of golf club head 500 and FIG. 10 is an enlarged cross-sectional view enlarging a portion of a cross-sectional view of golf club head 500 taken along a vertical plane passing through the center of the striking face 520 and extending in a fore-aft direction via circular region A shown in FIG. 9.

At first glance, golf club head 500 appears quite similar to the other exemplary golf club heads. Golf club head 500 includes a first portion 530 at least partially formed of an alloy of titanium and a second portion 540 at least partially formed of an alloy of steel. Golf club head 500 differs from the other exemplary golf club heads in that a third portion 550 is disposed between the first portion 530 and the second portion 540. The first portion 530 of golf club head 500 includes the striking face 520, the hosel 518, a forwardmost portion of the sole 508, a forwardmost portion of the crown 506, a forwardmost portion of the toe 502, a forwardmost portion of the heel (not shown), and a forward most portion of the skirt 510. The first portion 530 and the second portion 540 are joined by the third portion 550. According to an exemplary embodiment of the present invention, the third portion 550 is formed of a thermoset or thermoplastic composite material. As the third portion 550 separates the first portion 530 from the second portion 540, two parting lines 512 are shown at the boundaries between the first portion 530, the second portion 540, and the third portion 550. As above, the parting lines 512 are shown with a heavier line weight for emphasis.

As noted above, the striking face 520 may be formed concurrently with the other elements of the first portion 530, or alternatively, the striking face 520 may be formed separately from the other elements of the first portion 530 and subsequently joined thereto. Golf club head 500 shares the benefits of the above golf club heads in that the titanium striking face 520 may be constructed to have a reduced mass when compared to a steel striking face when both striking faces exhibit the same or similar COR. The golf club head 500 also exhibits the inertial benefits associated with utilizing steel in the sole 508 to concentrate mass in the lower portion of the golf club head 500.

The first portion 530 may account for between about 5 percent to about 35 percent of the total mass of the golf club head 500. More preferably, the first portion 530 may account for between about 5 percent to about 30 percent of the total mass of the golf club head 500. Most preferably, the first portion 530 may account for between about 5 percent to about 25 percent of the total mass of the golf club head 500.

The first portion 530 may account for between about 5 percent to about 45 percent of the external surface area of the golf club head 500. More preferably, the first portion 530 may account for between about 5 percent to about 40 percent of the external surface area of the golf club head 500. Most preferably, the first portion 530 may account for between about 5 percent to about 35 percent of the external surface area of the golf club head 500.

The second portion 540 may account for between about 65 percent to about 95 percent of the total mass of the golf club head 500. More preferably, the second portion 540 may account for between about 70 percent to about 95 percent of the total mass of the golf club head 500. Most preferably, the second portion 540 may account for between about 75 percent to about 95 percent of the total mass of the golf club head 500.

The second portion 540 may account for between about 55 percent to about 95 percent of the external surface area of the golf club head 500. More preferably, the second portion 540 may account for between about 60 percent to about 95 percent of the external surface area of the golf club head 500. Most preferably, the second portion 540 may account for between about 65 percent to about 95 percent of the external surface area of the golf club head 500.

Referring to FIG. 10, it can be seen that the third portion 550 joins the first portion 530 and the second portion 540. The third portion 550 includes a main body 5501 having a first groove 5502 and a second groove 5504 defined therein. The first groove 5502 is defined in a frontal edge 5503 of the third portion 550 that faces the first portion 530 and the second groove 5504 is defined in a rear edge 5505 of the third portion 550 that faces the second portion 540. The first portion 530 includes a main body 5301 and a tongue 5302 that is configured to be fittedly received within the first groove 5502 defined in the frontal edge 5503 of the third portion 550. The second portion 540 includes a main body 5401 and a tongue 5402 that is configured to be fittedly received within the second groove 5504 defined in the rear edge 5505 of the third portion 550.

While the first portion 530 and the second portion 540 may be joined to the third portion 550 through any known method, it is preferable that the first portion 530 and the second portion 540 may be joined to the third portion 550 via adhesives or by co-curing the third portion 550 with the first portion 530 and the second portion 540 such that a resin of the third portion 550 may flow and bond directly with the first portion 530 and/or the second portion 540.

While the external surfaces of each of the first portion 530, the second portion 540, and the third portion 550 that collectively define the crown 506 are shown as being substantially coplanar, it is also within the scope and content of the present invention for one or more of the first portion 530, the second portion 540, and the third portion 550 to extend above or below the general contours of the crown 506.

In the present embodiment the third portion 550 has the general shape of a ring that includes portions of the crown 506, skirt 510, toe 502, heel (not shown), and sole 508. It is also within the scope and content of the present invention for the third portion 550 to take on other shapes. A composite third portion could be interposed between any of the first and second portions disclosed in the present disclosure.

Figure 11:
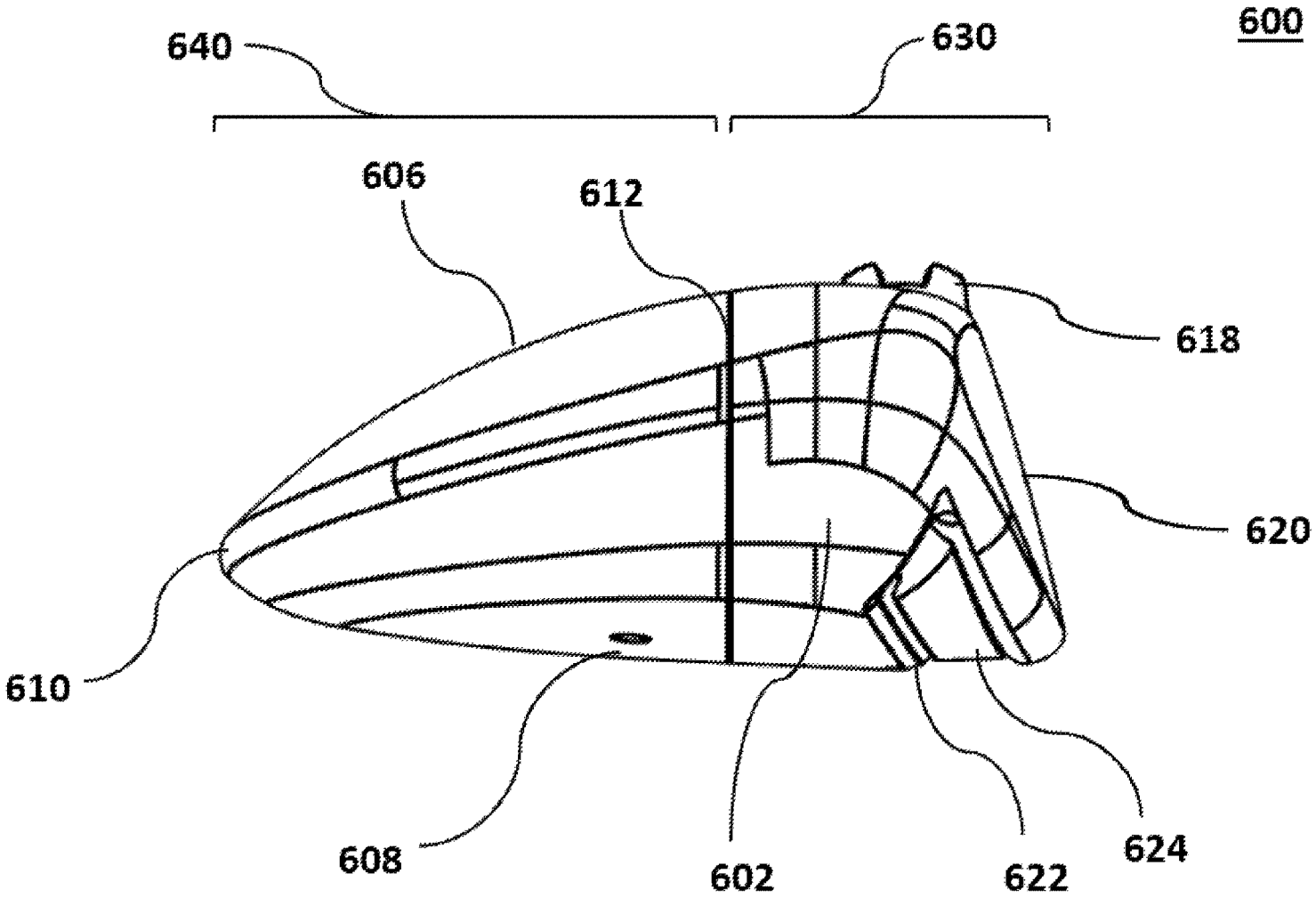
FIG. 11 of the accompanying drawings shows a toe-side view of a golf club head in accordance with another embodiment of the present invention.
Figure 12:
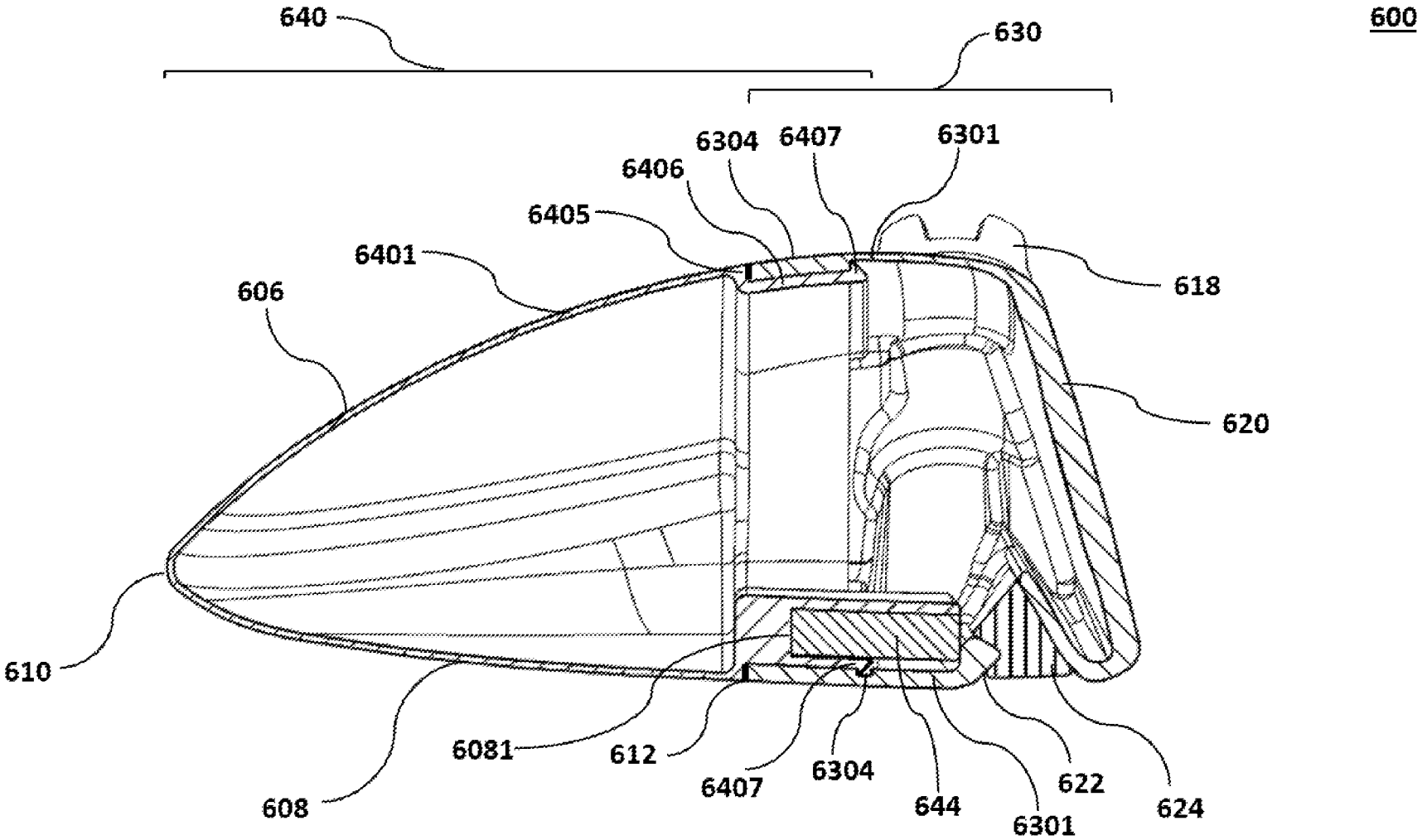
FIG. 12 of the accompanying drawings shows a toe-side cross-sectional view of the golf club head of FIG. 11 taken along a vertical axis passing through the center of the striking face and extending in a fore-aft direction.

Referring now to FIGS. 11-12, a golf club head 600 according to another exemplary embodiment of the present invention is shown. FIG. 11 is a toe-side view of golf club head 600 and FIG. 12 is a toe-side sectional view of golf club head 600 taken along a vertical plane passing through the center of the striking face 620 and extending in the fore-aft direction.

At first glance, golf club head 600 appears quite similar to the other exemplary golf club heads. Golf club head 600 includes a first portion 630 at least partially formed of an alloy of titanium and a second portion 640 at least partially formed of an alloy of steel. Golf club head 600 differs from the other exemplary golf club heads in that an active recoil channel 622 is defined in sole 608 within the first portion 630. Additionally, the parting line 612, which is again shown in heavier line weight for emphasis, is set further back from the striking face 620 for reasons that will be more apparent upon closer examination of FIG. 12.

The first portion 630 of golf club head 600 includes the striking face 620, the hosel 618, a forwardmost portion of the sole 608, a forward most portion of the toe 602, a forwardmost portion of the heel (not shown), and a forwardmost portion of the crown 606.

As noted above, the striking face 620 may be formed concurrently with the other elements of the first portion 630, or alternatively, the striking face 620 may be formed separately from the other elements of the first portion 630 and subsequently joined thereto. Golf club head 600 shares the benefits of the other exemplary golf club heads in that the titanium striking face 620 may be constructed to have a reduced mass when compared to a steel striking face when both striking faces exhibit the same or similar COR. The golf club head 600 also exhibits the inertial benefits associated with utilizing steel in the sole 608 to concentrate mass in the lower portion of the golf club head 600.

The first portion 630 may account for between about 5 percent to about 35 percent of the total mass of the golf club head 600. More preferably, the first portion 630 may account for between about 5 percent to about 30 percent of the total mass of the golf club head 600. Most preferably, the first portion 630 may account for between about 5 percent to about 25 percent of the total mass of the golf club head 600.

The first portion 630 may account for between about 5 percent to about 45 percent of the external surface area of the golf club head 600. More preferably, the first portion 630 may account for between about 5 percent to about 40 percent of the external surface area of the golf club head 600. Most preferably, the first portion 630 may account for between about 5 percent to about 35 percent of the external surface area of the golf club head 600.

The second portion 640 may account for between about 65 percent to about 95 percent of the total mass of the golf club head 600. More preferably, the second portion 640 may account for between about 70 percent to about 95 percent of the total mass of the golf club head 600. Most preferably, the second portion 640 may account for between about 75 percent to about 95 percent of the total mass of the golf club head 600.

The second portion 640 may account for between about 55 percent to about 95 percent of the external surface area of the golf club head 600. More preferably, the second portion 640 may account for between about 60 percent to about 95 percent of the external surface area of the golf club head 600. Most preferably, the second portion 640 may account for between about 65 percent to about 95 percent of the external surface area of the golf club head 600.

Referring now to FIG. 12, several additional unique features of golf club head 600 are more clearly illustrated. First of all, an active recoil channel (ARC) 622 is defined in the sole 608 of the golf club head 600 and an insert 624 is fitted within the ARC 622. The insert 624 reinforces the ARC 622 while also preventing dirt and debris from entering the interior of the golf club head 600 during use. The ARC 622 increases the compliance of the striking face 620 upon impact with a golf ball, especially when that impact occurs below the center of the striking face 620. The inclusion of the ARC 622 results in reduced mass, higher launch, lower spin, and increased ball speed when compared to a golf club head that does not include an ARC. As above, any reduction in mass affords designers with additional discretionary mass that may be allocated in areas that are most beneficial to the performance of the golf club head. In the current exemplary embodiment, the ARC 622 is formed entirely in the first portion 630, but it is within the scope and content of the present invention for the ARC 622 to be formed partially or entirely within the second portion 640. For example, the portion of the ARC 622 closest to the striking face 620 may be defined by the first portion 630 while the portion of the ARC 622 closest to the rear of the golf club head 600 may be defined by the second portion 640.

FIG. 12 also illustrates an additional method of joining the first portion 630 and the second portion 640 that may be used instead of, or in addition to, any of the joining techniques described herein. In the present embodiment, the first portion 630 and the second portion 640 are configured to be snap-fit together. As shown in FIG. 12, the second portion 640 includes a main body 6401, a riser 6405, a ledge 6406, and a barb 6407. The riser 6405 extends away from the crown 606 toward the interior of the golf club head 600. The ledge 6406 extends away from the riser 6405 and toward the striking face 620 of the first portion 630. The barb 6407 extends from the ledge 6406 toward the exterior of the golf club head 600. The first portion 630 includes a main body 6301 and barb mating portion 6304 having a thickness that is different than the adjacent portion of the main body 6301. The barb 6407 and the barb mating portion 6304 are configured such that when the first portion 630 and the second portion 640 are drawn together, at least one of the first portion 630 and the second portion 640 elastically deforms until the first portion 630 and the second portion 640 are fully engaged. Once the first portion 630 and the second portion 640 are fully engaged, the barb 6407 fixedly engages the barb mating portion 6304. At least a portion of the interface between the first portion 630 and the second portion 640 is configured as described above.

The sole 608 shows an alternative configuration that may be utilized in conjunction with the above configuration. Alternatively, either the crown configuration or the sole configuration may be used exclusively. In the alternative configuration, the barb mating portion 6304 defined in the sole 608 is configured as a recess defined within the main body 6301 of the first portion 630 whereas the barb mating portion 6304 defined in the crown 606 is configured as region of increased thickness as compared to the main body 6301.

FIG. 12 also illustrates an alternative manner of securing a first mass portion 644 to the golf club head 600. As described above, golf club head 600 is designed to have an overall size and weight that is similar to conventional small-format metal woods. As the first portion 630 includes an alloy of titanium and accounts for a substantial percentage of golf club head, it is necessary to allocate additional mass as discretionary mass to balance the volume and mass of the golf club head as described above. In the present embodiment, a pocket 6081 is defined in the sole 608 within the second portion 640. The pocket 6081 is configured to at least partially encapsulate the first mass portion 644. As described above, the first mass portion 644 may be secured within the pocket 6081 via any known manner, for example by at least one of welding, brazing, adhesives, mechanical fasteners, and mechanical locking. Preferably the first mass portion 644 includes a material having a higher density than that of the first portion 630 and/or the second portion 640 such as tungsten, molybdenum, tantalum, hafnium, niobium, or steel.

Figure 13:
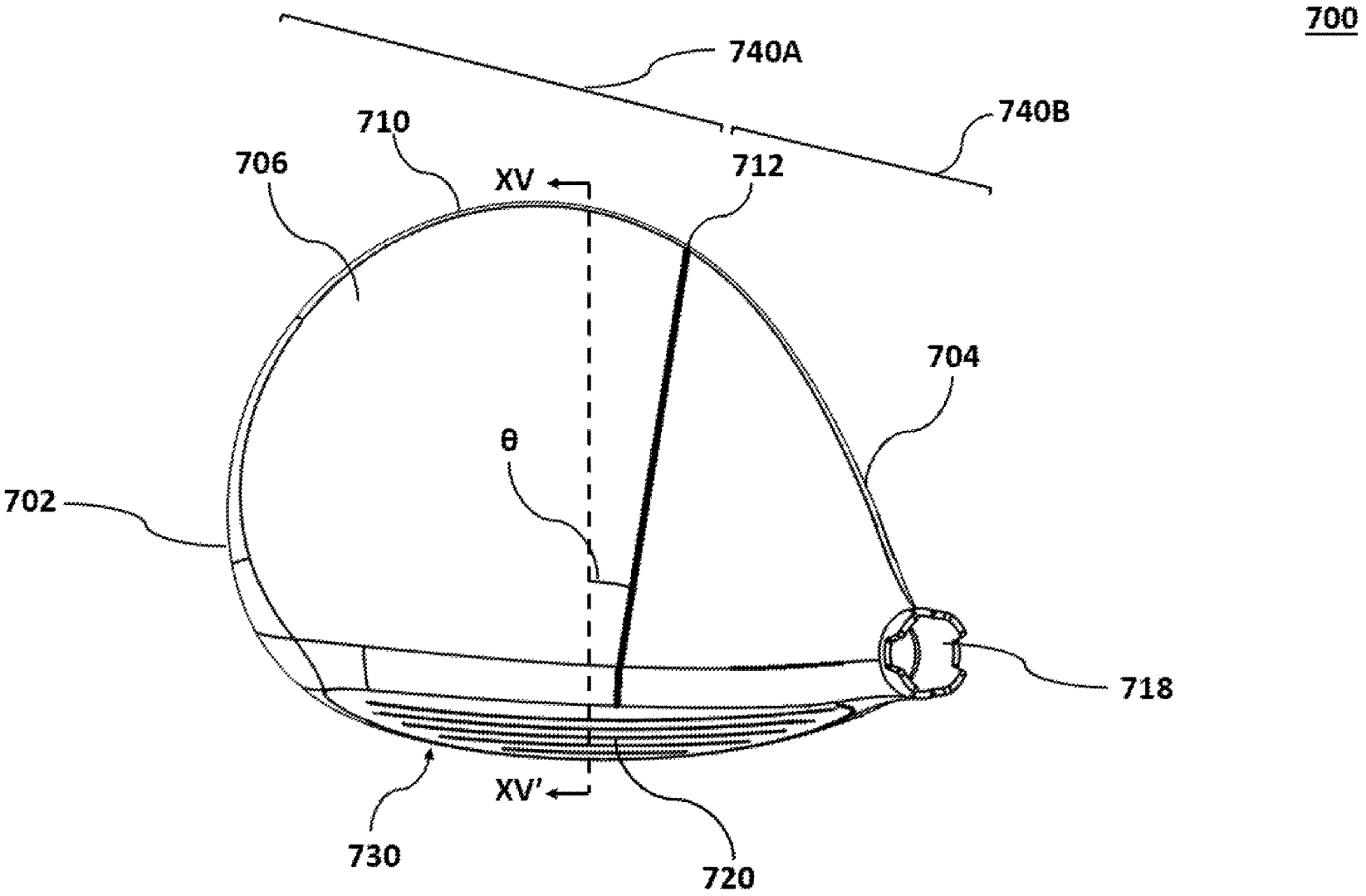
FIG. 13 of the accompanying drawings shows a crown view of a golf club head in accordance with another embodiment of the present invention.
Figure 14:
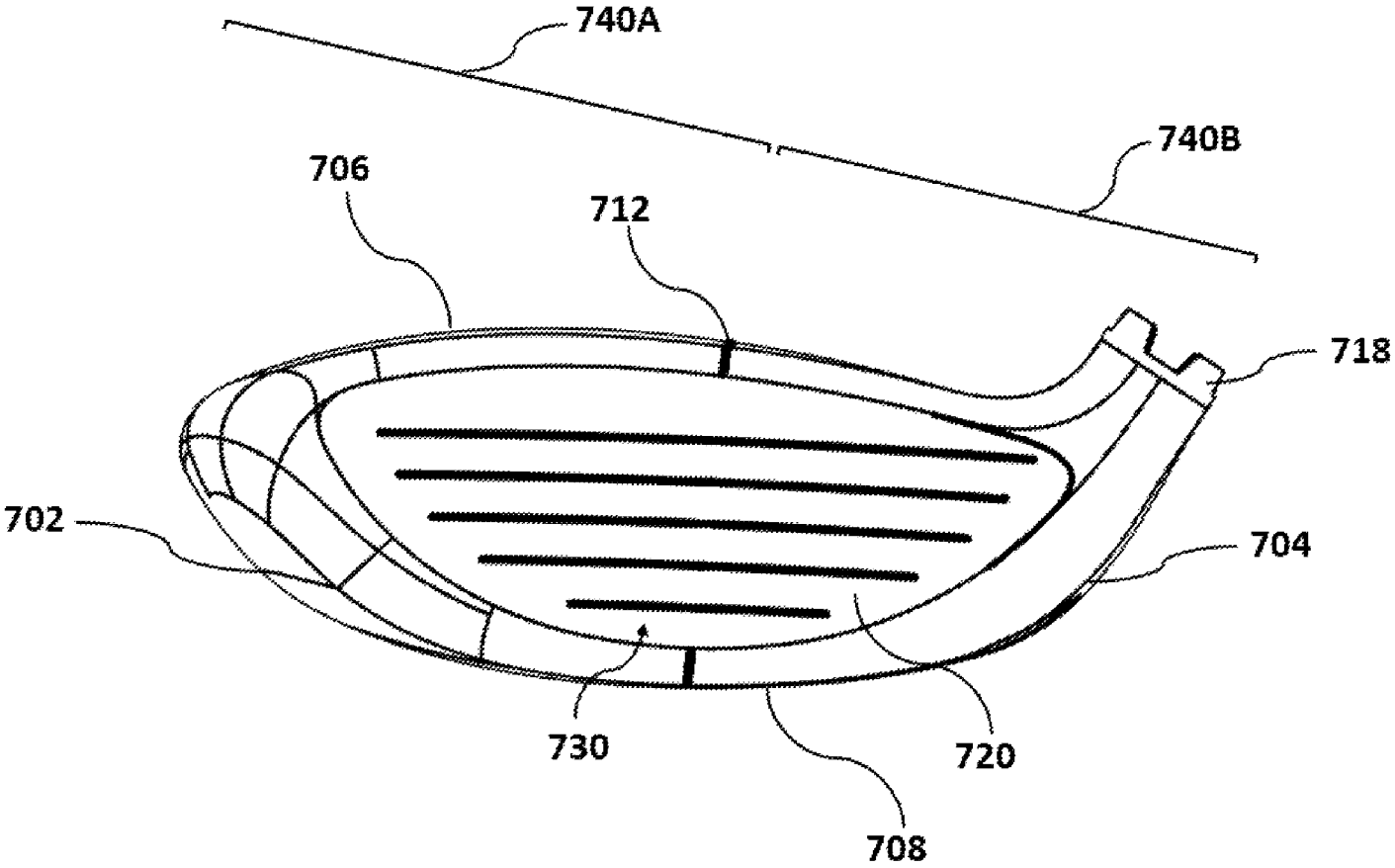
FIG. 14 of the accompanying drawings shows a frontal view of the golf club head of FIG. 13.
Figure 15:
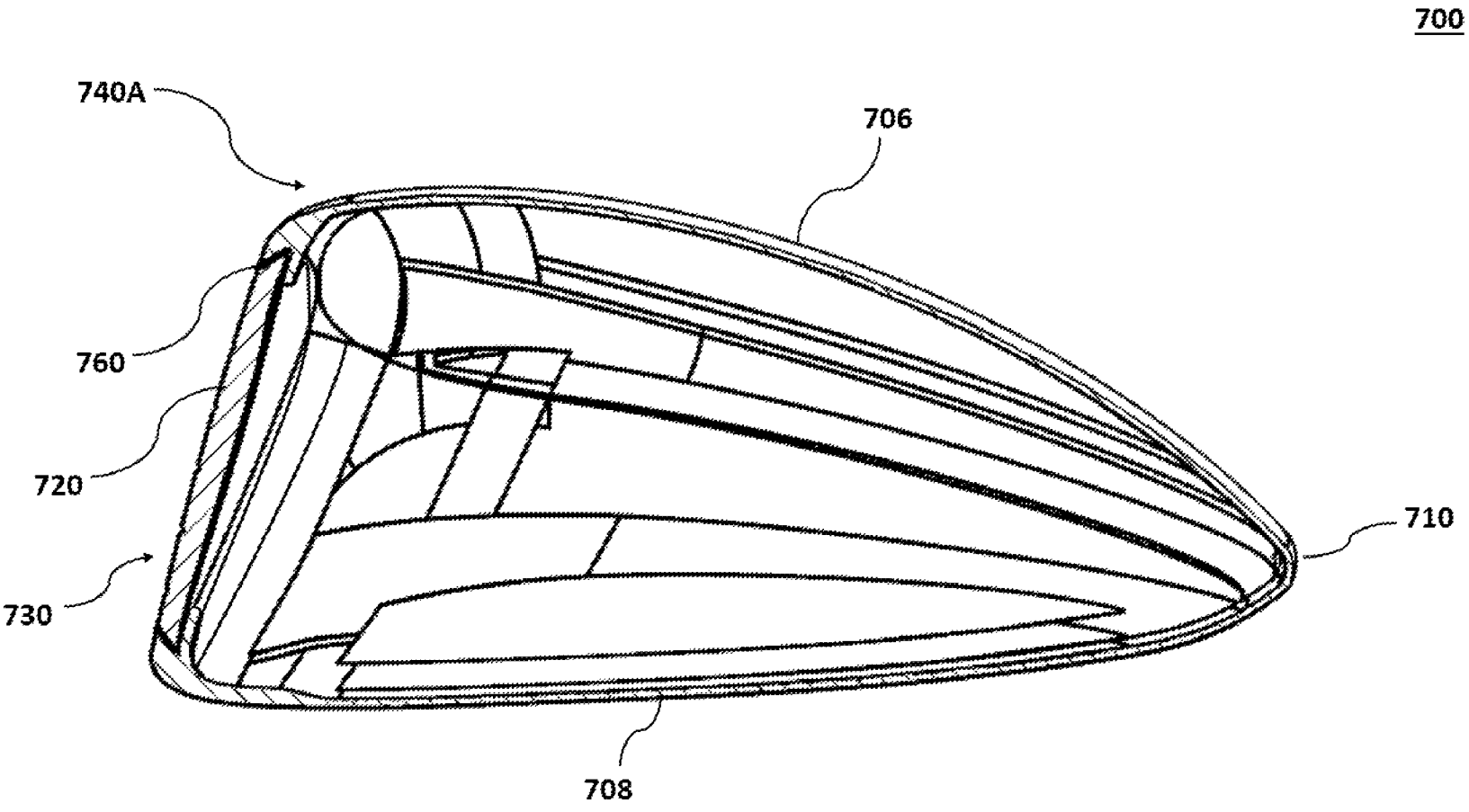
FIG. 15 of the accompanying drawings shows a heel-side cross-sectional view of the golf club head of FIG. 13 taken along line XV-XV' of FIG. 13.

Referring now to FIGS. 13-15, a golf club head 700 according to another exemplary embodiment of the present invention is shown. FIG. 13 is crown view of the golf club head 700, FIG. 14 is a frontal view of the golf club head 700, and FIG. 15 is a heel-side cross-sectional view of the golf club head 700 taken along the line XV-XV' in FIG. 13.

As shown in FIGS. 13 and 14, the golf club head 700 is similar to the other exemplary golf club heads in that it is a multi-piece construction that combines alloys of titanium and alloys of steel. The golf club head 700 differs from the golf club heads above in how those materials are utilized. The golf club head 700 includes a first portion 730 including the striking face 720. The golf club head 700 includes a second portion including a toe-side second portion 740A and a heel-side second portion 740B separated from each other by parting line 712. The toe-side second portion 740A and the heel-side second portion 740B collectively define the hosel 718, the crown 706, the heel 704, the toe 702, the skirt 710, and the sole 708.

The first portion 730 may be formed of an alloy of titanium. The toe-side second portion 740A and the heel-side second portion 740B may be formed of an alloy of steel. The golf club head 700 therefore may therefore exhibit the same mass and inertial attributes described above, while also maintaining the dimensions of a conventional small-format metal wood.

The first portion 730 may account for between about 5 percent to about 15 percent of the total mass of the golf club head 700. Preferably the first portion 730 may account for between about 6 to about 10 percent of the total mass of the golf club head 700. Most preferably the first portion 730 may account for about 7 percent of the total mass of the golf club head 700.

The first portion 730 may account for between about 5 percent to about 15 percent of the external surface area of the golf club head 700. Preferably the first portion 730 may account for between about 6 percent to about 10 percent of the external surface area of the golf club head 700. Most preferably the first portion 730 may account for about 7 percent of the external surface area of the golf club head 700.

Preferably, the toe-side second portion 740A and the heel-side second portion 740B may collectively account for between about 85 percent to about 95 percent of the total mass of the golf club head 700. Preferably, the toe-side second portion 740A and the heel-side second portion 740B may collectively account for between about 90 percent to about 94 percent of the total mass of the golf club head 700. Most preferably, the toe-side second portion 740A and the heel-side second portion 740B may collectively account for about 93 percent of the total mass of the golf club head 700.

Preferably, the toe-side second portion 740A and the heel-side second portion 740B may collectively account for between about 85 percent to about 95 percent of the external surface area of the golf club head 700. Preferably, the toe-side second portion 740A and the heel-side second portion 740B may collectively account for between about 90 percent to about 94 percent of the external surface area of the golf club head 700. Most preferably, the toe-side second portion 740A and the heel-side second portion 740B may collectively account for about 93 percent of the external surface area of the golf club head 700.

The first portion 730 may be joined to the toe-side second portion 740A and the heel-side second portion 740B by any known method, including brazing, adhesives, physical trapping, and mechanical fasteners. Preferably the first portion 730 is joined to the toe-side second portion 740A and the heel-side second portion 740B via a combination of adhesives and physical trapping as described below. The toe-side second portion 740A and the heel-side second portion 740B may be joined to each other by any known method, including welding, adhesives, physical trapping, and mechanical fasteners. Preferably the toe-side second portion 740A is joined to the heel-side second portion 740B via welding such that the parting line 712 may constitute a weld bead.

According to an exemplary embodiment, the parting line 712 may be horizontally offset relative to the center of said striking face 720. The parting line may also be formed at an angle θ relative to the vertical plane passing through the center of the striking face 720 and extending in the fore-aft direction as shown in FIG. 13. The angle θ may be between about 0 degrees and about 90 degrees, preferably between about 5 degrees to about 45 degrees, and most preferably between about 10 degrees and 25 degrees.

FIG. 15 is a cross-sectional view of golf club head 700 taken along the line XV-XV' in FIG. 13. As shown in FIG. 15, the first portion 730 includes the striking face 720, a perimeter portion of which is received within an undercut pocket 760 defined in the toe-side second portion 740A and the heel-side second portion 740B (not shown). The undercut pocket 760, in combination with the bifurcation of the second portion 740 into the toe-side second portion 740A and the heel-side second portion 740B, is configured such that a perimeter portion of the striking face 720 may be inserted into the undercut pocket 760 before the toe-side second portion 740A and the heel-side second portion 740B are joined together to complete the golf club head 700. In this embodiment, the toe-side second portion 740A may be slid in a heelward direction around the first portion 730 including the striking face 720, and the heel-side second portion 740B may be slid in a toeward direction around the first portion 730 including the striking face 720. The undercut pocket 760 is dimensioned so as to securely capture the striking face 720 and an adhesive (not shown) once the toe-side second portion 740A and the heel-side second portion 740B are joined together, preferably via welding.

Figure 16:
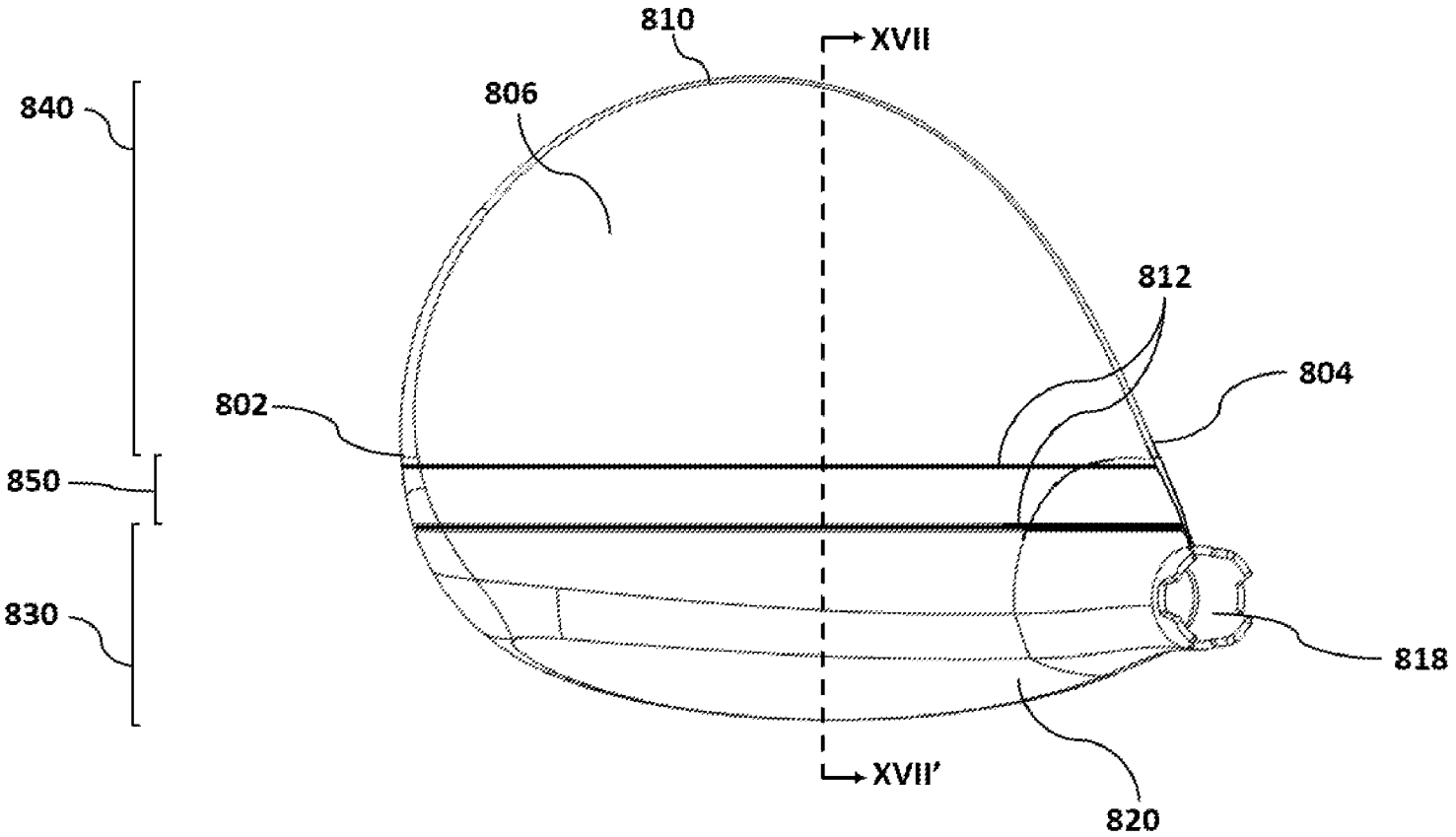
FIG. 16 of the accompanying drawings shows a crown view of a golf club head in accordance with another embodiment of the present invention.
Figure 17:
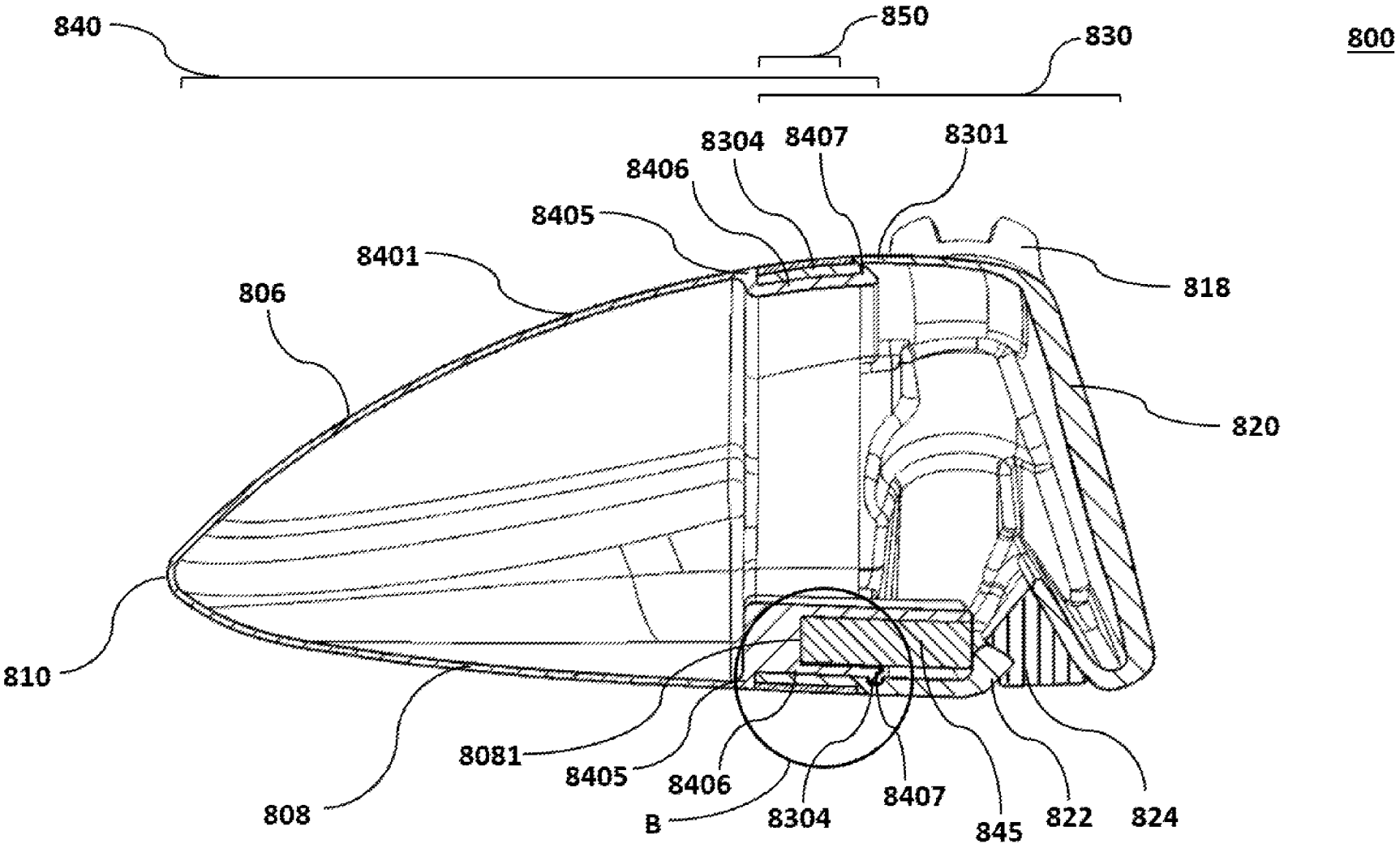
FIG. 17 of the accompanying drawings shows a toe-side cross-sectional view of the golf club head of FIG. 16 taken along the line XVII-XVII' of FIG. 16.
Figure 18:
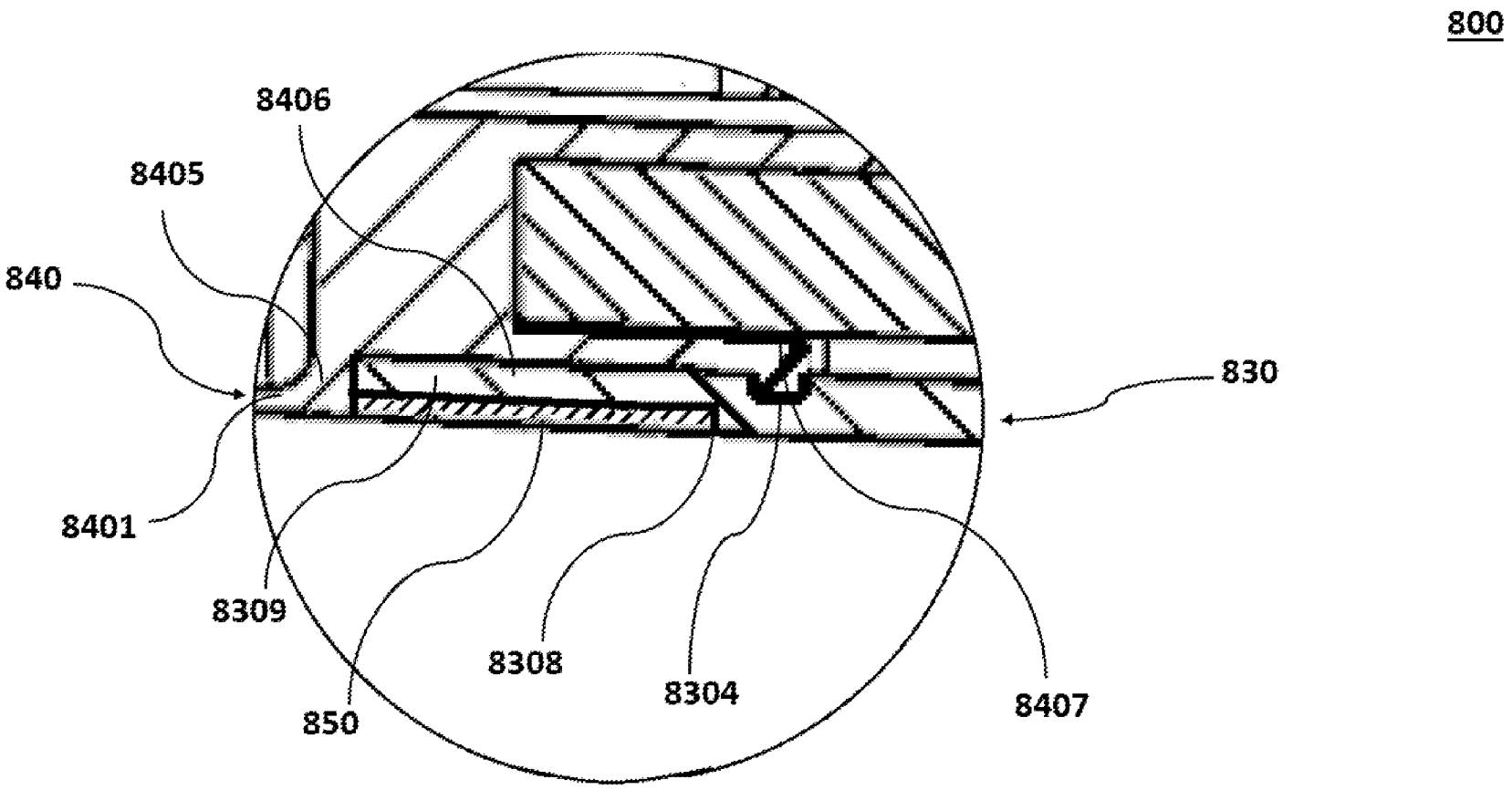
FIG. 18 of the accompanying drawings shows an enlarged cross-sectional view of the golf club head of FIG. 16.

Referring now to FIGS. 16-18, a golf club head 800 is shown. FIG. 16 is a crown view of the golf club head 800, FIG. 17, is a cross-sectional view taken along the line XVII-XVII' in FIG. 16, and FIG. 18. is an enlarged cross-sectional view, enlarging a portion of the golf club head 800 via circular region B shown in FIG. 17.

Referring to FIG. 16, golf club head 800 is similar to the other exemplary golf club heads in that it includes a first portion 830 formed at least partially of an alloy of titanium and a second portion 840 formed at least partially of an alloy of steel. The first portion 830 includes a striking face 820, the hosel 818, and front portions of the crown 806, the skirt 810, the toe 802, the heel 804, and the sole 808. The second portion 840 includes rear portions of the crown 806, skirt 810, the toe 802, the heel 804, and the sole 808. Much like golf club head 500 (shown in FIG. 9), golf club head 800 also includes a third portion 850.

The third portion 850 is preferably formed of steel or a composite material. The first portion 830 and the second portion 840 may be joined together through any known method, for example via adhesives, brazing, mechanical fasteners, mechanical locking, or the like. Preferably the first portion 830 is joined to the second portion 840 via mechanical fasteners and/or mechanical locking.

The first portion 830 may account for between about 5 percent to about 35 percent of the total mass of the golf club head 800. More preferably, the first portion 830 may account for between about 5 percent to about 30 percent of the total mass of the golf club head 800. Most preferably, the first portion 830 may account for between about 5 percent to about 25 percent of the total mass of the golf club head 800.

The first portion 830 may account for between about 5 percent to about 45 percent of the external surface area of the golf club head 800. More preferably, the first portion 830 may account for between about 5 percent to about 40 percent of the external surface area of the golf club head 800. Most preferably, the first portion 830 may account for between about 5 percent to about 35 percent of the external surface area of the golf club head 800.

The second portion 840 may account for between about 65 percent to about 95 percent of the total mass of the golf club head 800. More preferably, the second portion 840 may account for between about 70 percent to about 95 percent of the total mass of the golf club head 800. Most preferably, the second portion 840 may account for between about 75 percent to about 95 percent of the total mass of the golf club head 800.

The second portion 840 may account for between about 55 percent to about 95 percent of the external surface area of the golf club head 800. More preferably, the second portion 840 may account for between about 60 percent to about 95 percent of the external surface area of the golf club head 800. Most preferably, the second portion 840 may account for between about 65 percent to about 95 percent of the external surface area of the golf club head 800.

According to the present embodiment, the first portion 830 may be joined to the second portion 840 via a snap-fit mechanism. As shown in FIG. 17, in the crown 806 the second portion 840 includes a main body 8401, a riser 8405, a ledge 8406, and a barb 8407. The riser 8405 extends away from the main body 8401 toward the interior of the golf club head 800. The ledge 8406 extends away from the riser 8405 and toward the striking face 820. The barb 8407 extends from the riser 8405 toward exterior of the golf club head 800. In the crown 806, first portion 830 includes a main body 8301 and barb mating portion 8304. Golf club head 800 also may include a first mass portion 844 secured within a pocket 8081 and an insert 824 fitted within an ARC 822. The sole 808 shows an alternative configuration of the snap-fit mechanism in the sole 808 which includes a recess-type barb mating portion 8304. As these features are similar to those described above with regard to golf club head 500, further description thereof is omitted for brevity.

One feature that distinguishes golf club head 800 from golf club head 500 is the inclusion of a third portion 850 that fully surrounds the golf club head 800 at the interface of the first portion 830 and the second portion 840. To better illustrate the third portion 850, an enlarged view is provided in FIG. 18, enlarging a portion of the golf club head 800 via circular region B shown in FIG. 17.

As shown in FIG. 18, a circumferential recess 8308 is defined around the rear circumferential edge 8309 of the first portion 830. The third portion 850 is received within the circumferential recess 8308 and applies a compressive force to reinforce the joining of the first portion 830 to the second portion 840. The third portion 850 may be joined to the golf club head 800 in any known manner, for example via welding, brazing, adhesives, mechanical fasteners, or the like. Preferably, in a case where the third portion 850 is formed of a steel alloy, the third portion 850 is configured as an elongate band having terminal ends welded each other, and applies a clamping pressure to the first portion 830 and the second portion 840. Alternatively, in a case where the third portion 850 is formed of a composite material, it is preferable that the composite material is cured within the circumferential recess 8308 for a predetermined time, at a predetermined temperature, and at a predetermined pressure. Once cured, the composite third portion 850 similarly may apply a clamping pressure to reinforce the joining of the first portion 830 and the second portion 840.

According to another alternative embodiment of the present invention, the third portion 850 may be used to join an external first mass portion (not shown) to the golf club head 800. The first mass portion may be fitted within a recess similar to recess 347. In such a case, the third portion 850 may apply a clamping pressure to not only reinforce the joining of the first portion 830 and the second portion 840, but also to secure the external first mass within the recess. Such an external first mass may be further secured via known methods including adhesives and mechanical fasteners.

Figure 19:
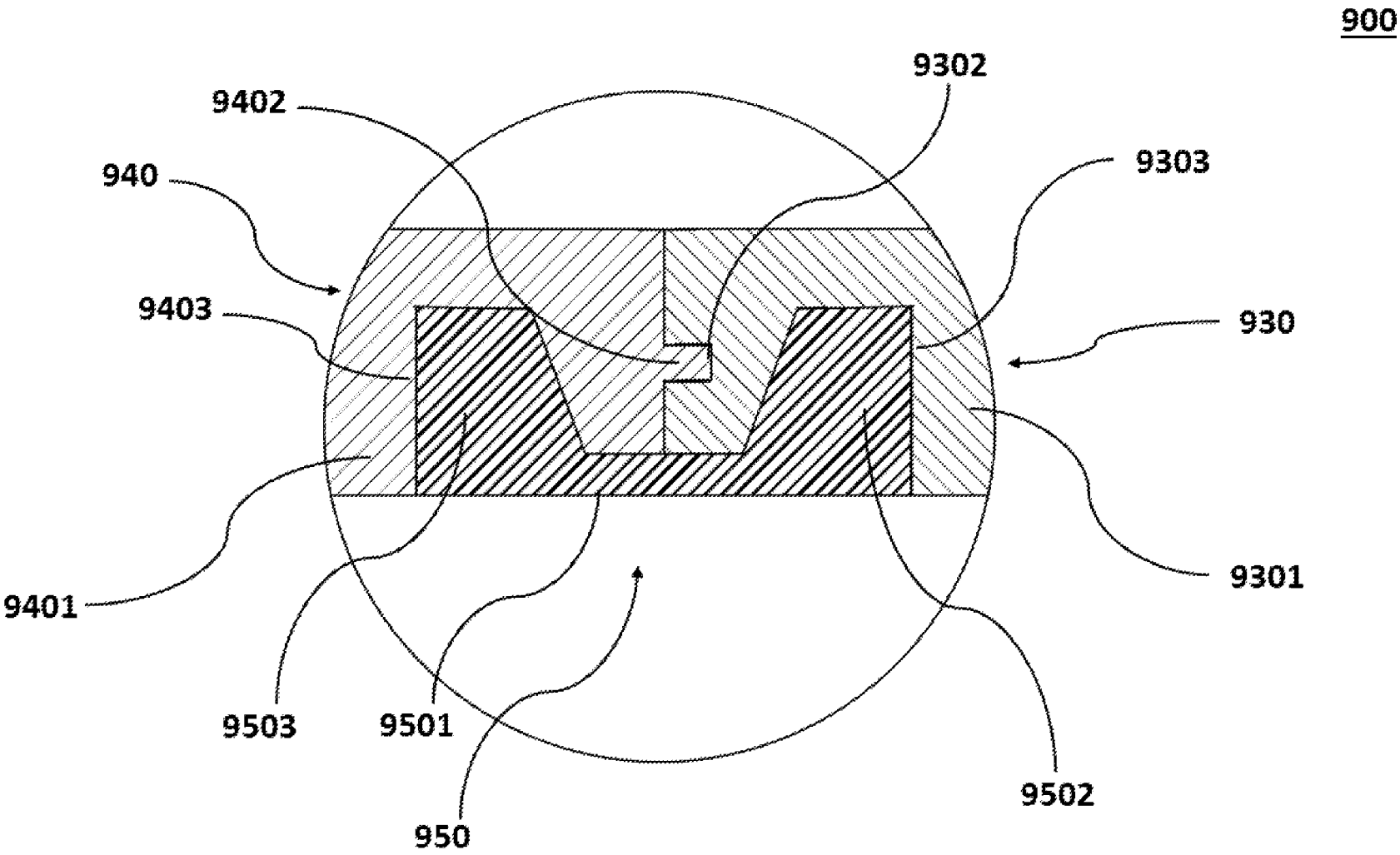
FIG. 19 of the accompanying drawings shows an enlarged cross-sectional view of a golf club head in accordance with another embodiment of the present invention.

Referring now to FIG. 19, an enlarged sectional view of a golf club in accordance with an alternative embodiment taken from the same perspective as that shown in FIG. 18 is provided. From an exterior perspective, the golf club head shown in FIG. 19 is substantially the same as golf club head 800, therefore discussion thereof will be omitted for the sake of brevity. It is worth noting that the first portion 930 is formed at least partially of an alloy of titanium and at least includes the striking face and frontal portions of the crown, sole, heel, and toe, while the second portion 940 is formed at least partially of an alloy of steel and at least includes rear portions of the crown, sole, heel, and toe.

The first portion 930 may account for between about 5 percent to about 35 percent of the total mass of the golf club head 900. More preferably, the first portion 930 may account for between about 5 percent to about 30 percent of the total mass of the golf club head 900. Most preferably, the first portion 930 may account for between about 5 percent to about 25 percent of the total mass of the golf club head 900.

The first portion 930 may account for between about 5 percent to about 45 percent of the external surface area of the golf club head 900. More preferably, the first portion 930 may account for between about 5 percent to about 40 percent of the external surface area of the golf club head 900. Most preferably, the first portion 930 may account for between about 5 percent to about 35 percent of the external surface area of the golf club head 900.

The second portion 940 may account for between about 65 percent to about 95 percent of the total mass of the golf club head 900. More preferably, the second portion 940 may account for between about 70 percent to about 95 percent of the total mass of the golf club head 900. Most preferably, the second portion 940 may account for between about 75 percent to about 95 percent of the total mass of the golf club head 900.

The second portion 940 may account for between about 55 percent to about 95 percent of the external surface area of the golf club head 900. More preferably, the second portion 940 may account for between about 60 percent to about 95 percent of the external surface area of the golf club head 900. Most preferably, the second portion 940 may account for between about 65 percent to about 95 percent of the external surface area of the golf club head 900.

The differences between golf club head 800 and golf club head 900 can be seen from the enlarged sectional view shown in FIG. 19. As shown in FIG. 19, the first portion 930 abuts the second portion 940, while and the third portion 950 again surrounds the golf club head 900 at an interface of the first portion 930 and the second portion 940. Looking deeper, there are several additional features that further reinforce the joining of the first portion 930 and the second portion 940.

The first portion 930 includes a main body 9301, a first alignment feature 9302 being defined at a rearmost edge of the first portion 930, and a first recess 9303 defined in an external surface of the first portion 930. The second portion 940 includes a main body 9401, a second alignment feature 9402 being defined at a forwardmost edge of the second portion 940, and a second recess 9403 defined in an external surface of the second portion 940. The first alignment feature 9302 and the second alignment feature 9402 are configured to mate with each other to align the first portion 930 and the second portion 940. The first alignment feature 9302 and the second alignment feature 9402 may take on any number of configurations, for example, a tongue and groove as shown in FIG. 19. According to an exemplary embodiment, the second alignment feature 9402 may be a one of a tongue or a groove that is configured to mate with the first alignment feature 9302. The third portion 950 may be a circumferential ring having a "U" shaped cross-section defined by a main body 9501, a first projection 9502 corresponding to the first recess 9303, and a second projection 9503 corresponding to the second recess 9403. The third portion 950 applies a compressive force that draws the first portion 930 and the second portion 940 together and locks the first alignment feature 9302 and the second alignment feature 9402 as shown in FIG. 19. The third portion 950 may be formed of the same materials and in the same manner as third portion 850 above, thus further discussion thereof is omitted for brevity.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising a striking face at a front portion of said golf club head, a crown, a sole opposite said crown, a heel, a toe opposite said heel, a hosel adjacent said heel, and a skirt joining said crown to said sole and extending from said toe proximate said striking face to said heel proximate said striking face, said golf club head further comprising:

a first portion including at least said striking face, a forward portion of said crown, a forward portion of said sole, a forward portion of said toe, a forward portion of said heel, and a forward portion of said skirt, said first portion formed of a first material comprising an alloy of titanium;

a second portion including at least a rear portion of said sole, a rear portion of said crown, a rear portion of said toe, a rear portion of said heel, and a rear portion of said skirt, said second portion formed at least partially of a second material comprising an alloy of steel; and a third portion defining a ring that defines at least a portion of said crown, a portion of said sole, a portion of said toe, a portion of said heel, and a portion of said skirt, said third portion formed of a third material, wherein said ring mechanically captures said first portion and said second portion to facilitate joining of said first portion to said second portion, wherein said first portion is joined to said second portion by at least one of welding, brazing, adhesives, mechanical fasteners, and mechanical locking, wherein said first portion and said second portion collectively define a recess in said sole, and wherein a first mass portion is received within said recess.

2. The golf club head of claim 1, further comprising a threaded fastener, wherein said first portion further comprises a first portion opening, said second portion further comprises a second portion opening, and said first mass portion further comprises a first mass portion opening, wherein each of said first portion opening, said second portion opening, and said first mass portion opening are aligned along a longitudinal axis of said threaded fastener, and wherein said threaded fastener is configured to mate with threads defined in at least one of said first portion opening, said second portion opening, and said first mass portion opening, so as to apply a compressive force through each of said first mass portion, said first portion, and said second portion, thereby joining said first portion to said second portion.

3. The golf club head of claim 1, wherein said ring comprises a ring main body having a first groove defined in a frontal edge of said ring main body and a second groove defined in a rear edge of said ring main body, wherein said first portion comprises a first portion main body and a tongue configured to mate with said first groove defined in said frontal edge of said ring main body, wherein said second portion comprises a second portion main body and a tongue configured to mate with said second groove defined in said rear edge of said ring main body.

4. The golf club head of claim 1, wherein said first portion comprises a first portion main body, a first alignment feature defined at a rearmost edge of said first portion, and a first recess defined in an external surface of said first portion, wherein said second portion comprises a second portion main body, a second alignment feature defined at a forwardmost edge of said second portion and configured to mate with said first alignment feature of said first portion, and a second recess defined in an external surface of said second portion, and wherein said ring comprises a ring main body, a first projection configured to mate with said first recess of said first portion, and a second projection configured to mate with said second recess of said second portion.

5. A golf club head comprising a striking face at a front portion of said golf club head, a crown, a sole opposite said crown, a heel, a toe opposite said heel, a hosel adjacent said heel, and a skirt joining said crown to said sole and extending from said toe proximate said striking face to said heel proximate said striking face, said golf club head further comprising:

a first portion including at least said striking face, said first portion formed of a first material comprising an alloy of titanium; and a second portion including at least a rear portion of said sole of said golf club head, said second portion formed at least partially of a second material comprising an alloy of steel, wherein said first portion is joined to said second portion by at least one of welding, brazing, adhesives, mechanical fasteners, and mechanical locking, wherein said first portion accounts for between about 5 percent to about 35 percent of a total mass of the golf club head, and wherein said second portion accounts for between about 65 percent to about 95 percent of the total mass of the golf club head.

6. The golf club head of claim 5, wherein said first portion accounts for between about 5 percent to about 30 percent of a total mass of the golf club head, and wherein said second portion accounts for between about 70 percent to about 95 percent of the total mass of the golf club head.

7. The golf club head of claim 5, wherein said first portion accounts for between about 5 percent to about 45 percent of an external surface area of said golf club head, and wherein said second portion accounts for between about 55 percent to about 95 percent of said external surface area of said golf club head.

8. A golf club head comprising a striking face at a front portion of said golf club head, a crown, a sole opposite said crown, a heel, a toe opposite said heel, a hosel adjacent said heel, and a skirt joining said crown to said sole and extending from said toe proximate said striking face to said heel proximate said striking face, said golf club head further comprising:

a first portion including said striking face, said crown, and said skirt, said first portion formed of a first material comprising an alloy of titanium; and a second portion including at least a portion of said sole, said second portion formed at least partially of a second material comprising an alloy of steel, wherein said first portion is joined to said second portion by at least one of adhesives, mechanical fasteners, and mechanical locking, wherein said first portion accounts for between about 20 percent to about 40 percent of a total mass of the golf club head, and wherein said second portion accounts for between about 60 percent to about 80 percent of the total mass of the golf club head.

9. The golf club head of claim 8, wherein said first portion accounts for between about 25 percent to about 35 percent of a total mass of the golf club head, and wherein said second portion accounts for between about 65 percent to about 75 percent of the total mass of the golf club head.

10. The golf club head of claim 8, wherein said first portion accounts for between about 60 percent to about 80 percent of an external surface area of said golf club head, and wherein said second portion accounts for between about 20 percent to about 40 percent of said external surface area of said golf club head.

* * * * *